US006953079B2

(12) United States Patent
Suzuki et al.

(10) Patent No.: US 6,953,079 B2
(45) Date of Patent: Oct. 11, 2005

(54) DIE CASTING MACHINE

(75) Inventors: Kazuhiro Suzuki, Kanagawa (JP); Shoko Kubota, Kanagawa (JP); Kazumi Tsuruda, Shizuoka (JP); Isao Kuboki, Kanagawa (JP); Toshiaki Toyoshima, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/661,783

(22) Filed: Sep. 15, 2003

(65) Prior Publication Data

US 2004/0099399 A1 May 27, 2004

(30) Foreign Application Priority Data

Nov. 6, 2002 (JP) ..... 2002-323075
Nov. 19, 2002 (JP) ..... 2002-335577

(51) Int. Cl.[7] ..... B22D 11/12

(52) U.S. Cl. ..... 164/267; 164/312; 164/256; 164/268; 164/269

(58) Field of Search ..... 164/267, 72, 312, 164/61, 65, 113, 256, 457, 268, 269, 472

(56) References Cited

U.S. PATENT DOCUMENTS 4,949,775 A * 8/1990 Takehisa et al. ..... 164/267
4,989,663 A * 2/1991 Kitamura ..... 164/312
5,127,467 A * 7/1992 Ueno ..... 164/457
6,648,054 B2 * 11/2003 Kuramasu et al. ..... 164/61
6,742,566 B2 * 6/2004 Nishikawa et al. ..... 164/72

* cited by examiner

*Primary Examiner*—Tom Dunn
*Assistant Examiner*—I.-H. Lin
(74) *Attorney, Agent, or Firm*—Pillsbury Winthrop Shaw Pittman LLP

(57) ABSTRACT

A die casting machine injecting and filling a molten metal into a cavity formed between a pair of dies so as to cast a product, comprising an ejecting pin for ejecting a casting by its front and sticking out inside the cavity and a powder feeder for feeding a powder release agent for promoting release of the casting from the dies, the ejecting pin including a release agent feed path for guiding powder release agent fed from the powder feeder to a front end of the ejecting pin and feeding it to the cavity.

7 Claims, 18 Drawing Sheets

DIE CASTING MACHINE

BACKGROUND OF THE INVENTION

1. Field of the Invention

The present invention relates to a die casting machine.

2. Description of the Related Art

A die casting machine is provided with a pair of dies, a fixed die plate and a movable die plate for holding these dies, a clamping unit for opening, closing, and clamping the dies, an injection apparatus provided with a plunger and sleeve for injecting and filling molten metal into a cavity formed between the dies, etc.

In this due casting machine, to facilitate removal of the casting from the dies, the practice has been to coat a release agent on the inner surface of the cavity of the dies before casting. Further, to reduce the friction between the sleeve and plunger of the injection apparatus when injecting the molten metal into the cavity of the dies, the practice has been to coat a lubricant on the inner circumference of the sleeve before casting.

As the release agent and lubricant, in the past frequent use has been made of water-based release agents or water-based lubricants comprised of a release material or lubricating material dissolved in water. Recently, in place of these, powder release agents and powder lubricants comprised of powder materials have begun to be used.

Powder release agents and powder lubricants have various advantages compared with water-based release agents and water-based lubricants such as an easing of the temperature shock on the dies, reduction of entry or gas into the casting, high heat insulating effect due to the formation of an evaporating film, improvement of the release performance, reduction of noise, and lack of need for waste water treatment.

To get the powder release agent and powder lubricant to exhibit sufficient performance, however, it is necessary to cause them to uniformly disperse and deposit on the surface of the cavity of the dies and the inner circumference of the sleeve.

To coat a powder release agent on the surface of the cavity of dies, for example, the method is adopted of spraying the powder release agent into the cavity in a state with the dies clamped.

With this coating method, however, depending on the shape of the cavity etc., it is difficult to cause the powder release agent to uniformly disperse to the surface of the cavity. Unless the powder release agent is uniformly coated, the performance of the powder release agent cannot be sufficiently exhibited.

SUMMARY OF THE INVENTION

An object of the present invention is to provide a die casting machine enabling the performances of a powder release agent and powder lubricant to be sufficiently exhibited when casting using a powder release agent or lubricant and enabling a stable quality die casting to be produced.

According to a first aspect of the present invention, there is provided a die casting machine for injecting and filling a molten metal into a cavity formed between a pair of dies so as to form a casting, comprising a first ejecting pin for ejecting a casting formed inside the cavity from the dies and a release agent feeding means for feeding a powder release agent for promoting release of the casting from the dies, the first ejecting pin comprising a release agent feed path for guiding powder release agent fed from the release agent feeding means to a front end of the first ejecting pin and feeding it to the cavity from there.

Preferably, the die casting machine further includes a second ejecting pin not provided with the release agent food path and a drive means for making the first ejecting pin comprising the release agent feed path move with respect to the cavity independently from the second ejecting pin not provided with the release agent feed path.

Alternatively, the die casting machine further includes a lubricant feeding means for feeding a powder lubricant fog reducing friction between a sleeve communicated with the cavity and fed with the molten metal and a plunger for injecting and filling molten metal fed to the sleeve to the cavity, the first ejecting pin provided with the release agent feed path being comprising a lubricant food path for guiding powder lubricant fed from the lubricant feeding means to a front end of the first ejecting pin and feeding it to the sleeve from there.

Alternatively, the die casting machine further includes an evacuating means for evacuating and reducing the pressure in the cavity in the state with the dies clamped and starts the evaluation by the evacuating means, then feeds the powder release agent through the first ejecting pin to the inside of the cavity and disperses the fed powder release agent to make it deposit on an inner surface of the cavity by a flow of air generated by the evacuation.

More preferably, the first and second ejecting pins are provided to be able to stick out into a runner in the cavity, the release agent feed path opens facing the cavity side at the front end of the corresponding ejecting pin, and the lubricant feed path opens facing the sleeve side at the front end of the corresponding ejecting pin.

According to a second aspect of the invention, there is provided a die casting machine comprising a pair of dies; a sleeve comprised of two split parts held at the dies, communicated with a cavity formed between the dies, and fed with a molten metal; a plunger fitting into the sleeve and injecting and filling molten metal fed to the sleeve toward the cavity; an electromagnetic pump for feeding molten metal inside the sleeve through a malt feed pipe connected to one of the split parts of the sleeve; an evacuating means for evacuating and reducing, the pressure inside the cavity in the state with the dies clamped; a release agent feeding means for feeding inside the cavity a powder release agent for promoting release of a casting from the dies during evacuation by the evacuating means; a lubricant feeding means for injecting toward an inner circumference of the sleeve a powder lubricant for reducing friction between the inner circumference of the sleeve and the plunger after the end of evacuation by the evacuating means; and a gas evacuating means for evacuating gas inside the cavity and sleeve to the outside when a pressure inside a closed space formed by inner surfaces of the cavity and sleeve and a liquid surface of molten metal inside the melt feed pipe rises above ambient pressure.

Preferably, the gas evacuating means has a check valve provided between a chill-vent provided between the dies and the out of the dies.

More preferably, the gas evacuating means has a check valve provided between an evacuation path connecting the evacuating means and the cavity and the out of the dies.

In the first aspect of the invention, when the ejecting pin is pushed out into the cavity and powder release agent is fed to the release agent feed path from the release agent feeding means, the powder release agent is fed to the cavity from the front end. In this way, by forming a release agent feed path in the first ejecting pin inherently for ejecting the casting and feeding the powder release agent from the release agent feeding means, it is possible to make the first ejecting pin coat the powder release agent. Further, if supplying and stopping the powder release agent at the release agent feeding means side, there is no need to provide a control valve etc. at the dies.

In the second aspect of the invention, after clamping the dies, the inside of the cavity is evacuated and powder release agent is fed to the inside of the cavity. When the inside of the cavity is evacuated, a flow of air is created in the cavity. Therefore, the fed powder release agent diffuses inside the cavity due to the flow of air and the powder release agent deposits on the entire surface of the cavity.

After the completion of evacuation by the evacuating means, the powder lubricant is sprayed by the lubricant feeding means toward the inner circumference of the sleeve.

At this time, the inner surfaces of the cavity and the sleeve and the liquid surface of the molten metal in the melt feed pipe form a closed space, so due to the injection of the powder lubricant into the closed space, the pressure of the closed space rises and the liquid surface is pushed down, but the gas in the closed space is evacuated by the gas evacuating means and the pressure in the closed space quickly become equal to the ambient pressure. Due to this, due to the rise in pressure inside the closed space, fluctuations in the liquid surface of the molten metal are suppressed and an accurate amount of molten metal is fed into the sleeve by the electromagnetic pump.

BRIEF DESCRIPTION OF THE DRAWINGS

These and other objects and features of the present invention will become clearer from the following description of the preferred embodiments given with reference to the accompanying drawings, in which.

DESCRIPTION OF THE PREFERRED EMBODIMENTS

Below, preferred embodiments of the present invention will be described with reference to the accompanying drawings.

First Embodiment

Figure 1:
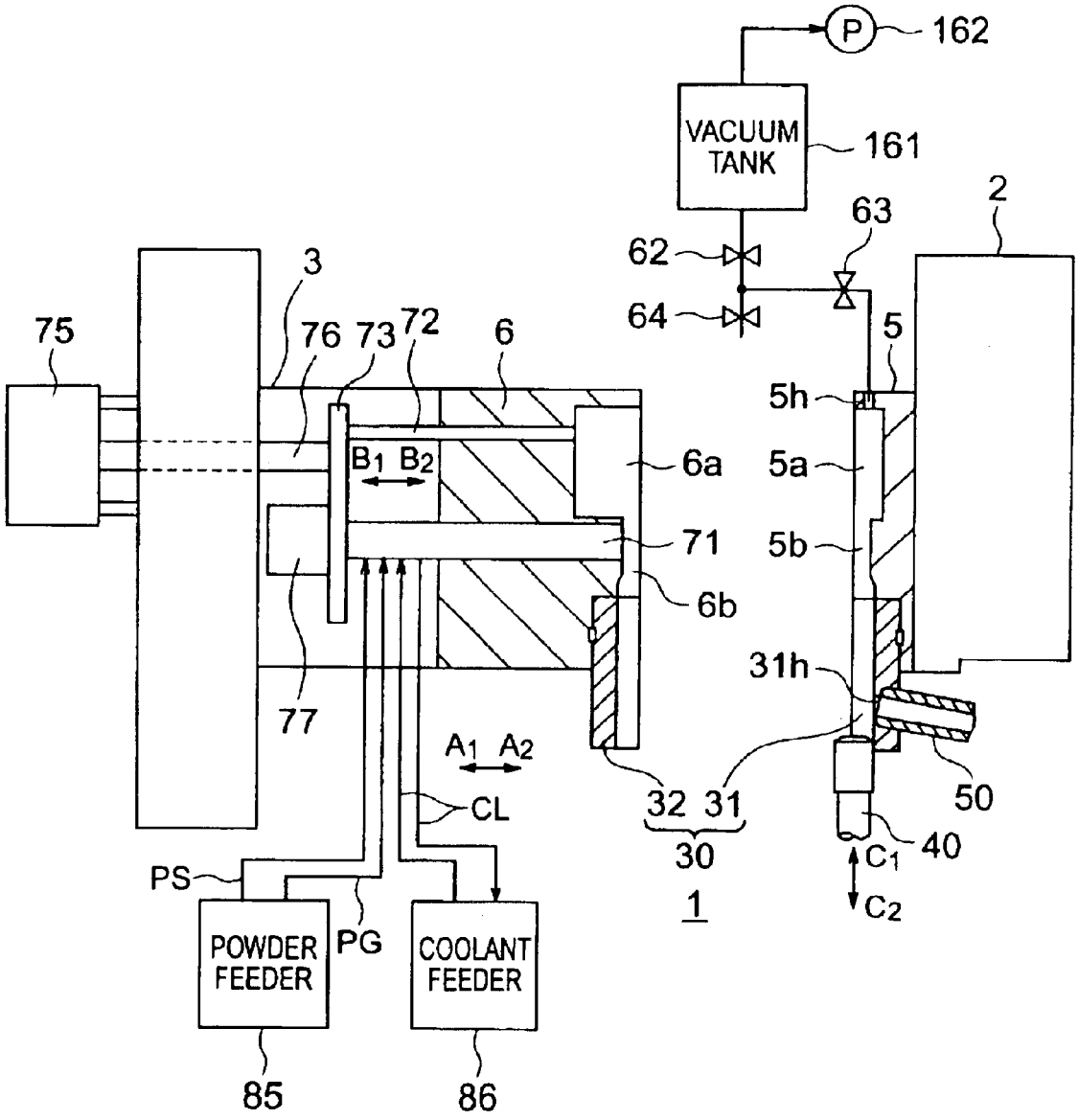
FIG. 1 is a sectional view in a vertical direction showing the configuration of a die casting machine according to an embodiment of the present invention.

FIG. 1 is a view along the vertical direction showing the configuration of a die casting machine according to an embodiment of the present invention.

In FIG. 1, a die casting machine 1 is provided with affixed die 3 held at a fixed die plate 2, a movable die 6 held at a movable die plate 3, a sleeve 30 comprised of a split part 31 fixed to the fixed die 5 and a split part 32 fixed to the movable die 6, a plunger 40 fitting into the sleeve 30, a malt feed pipe 50 connected to the sleeve 30, a vacuum tank 161 connected to the fixed die 5, a plurality of ejecting pins 71, 72 provided on the to movable die 6, a powder feeder 85, and a coolant feeder 86. Note that the vacuum tank 161 is an embodiment of the evacuating means of the present invention, while the powder feeder 85 is an embodiment of the release agent feeding means and lubricant feeding means of the present invention.

The fixed die plate 2 is fixed on a not shown base. The movable die plate 3 is set on a not shown base to be movable in the die opening/closing direction shown by the arrows A1 and A2. At the back of the movable die plate 3 in provided a not shown die clamping system. This die clamping system is connected with the fixed die plate 2 through the movable die plate 3 by a plurality of not shown tiebars. Due to the action of the die clamping system, the movable die plate 3 moves in the die opening/closing direction A1 and A2. Due to this, the fixed die 5 and the movable die 6 are opened and closed. In the state with the fixed die 5 and the movable die 6 closed, the movable die plate 3 moves further in the die closing direction A2, whereby the tiebars extend and the fixed die 5 and movable die 6 are clamped.

The fixed die 5 is formed with a recess 5*a* for forming a cavity in which a molten metal is to be filled and a recess 5*b* for forming a runner for guiding the molten metal to this cavity.

The movable die 6 is formed with, corresponding to the recesses 5*a* and 5*b* of the fixed die 5, a recess 6*a* for forming the cavity and a recess 6*b* for forming the runner for guiding the molten metal to the cavity.

The vacuum tank 161 is connected to an evacuation port 5*h* formed at a top and of the fixed die 5.

The vacuum tank 161 is connected to a vacuum pump 162. The inside of the vacuum tank 161 is reduced in pressure by the vacuum pump 162 to a predetermined level.

The reduced pressure vacuum tank 161 evacuates and reduces the pressure of the inside of the cavity formed between the fixed die 5 and movable die 6 through the evacuation port 5*h*. The vacuum tank 161 is again reduced in pressure by the vacuum pump 162 after the inside of the cavity is evacuated.

The pipeline connecting the vacuum tank 161 and fixed die 5 is provided with control valves 62 and 63. Further, the pipeline connecting the control valve 62 and control valve 63 is provided with a control valve 64. By suitably operating these control valves 62, 63, and 64, the inside of the cavity formed between the fixed die 5 and the movable die 6 is reduced in pressure.

The sleeve 30 is contrived of two split parts 31 and 32 fixed along the vertical direction at the bottom of the fixed die 5 and movable die 6 and formed into semicylindrical shapes. These split parts 31 and 32 form the cylindrical sleeve 30 by contacting each other when the fixed die 5 and movable die 6 are clamped.

The split part 31 fixed to the movable die 5 is connected to the melt food pipe 50. The malt food pipe 50 guides the molten metal fed from a not shown melt feeder to the sleeve 30. The guided molten metal is fed into the sleeve 30 through a gate 31*h* formed in the split part 31 of the sleeve 30. The melt feeder used may for example be an electromagnetic pump.

The plunger 40 fits into the inside of the sleeve 30 and is driven by a not shown injection cylinder or other drive source in the vertical direction shown by the arrows C1 and C2.

Ejecting Pins

The ejecting pins 71 and 72 are movably inserted into through holes formed in the movable die 6. The ejecting pin 72 is designed so that its front end can stick out into the recess 6*a* forming the cavity. The ejecting pin 71 is designed so that its front end can stick out into the recess 6*b* forming the runner for guiding the molten metal.

The ejecting pin 71 is provided movably at an ejecting plate 73 at the back side of the movable die 6. The ejecting pin 71 is connected with a hydraulic cylinder 77 provided at the ejecting plate 73. By the action of the hydraulic cylinder 77, the ejecting pin 71 is driven in the direction of the arrows B1 and B2 with respect to the ejecting plate 73.

The ejecting pin 72 is fixed to the ejecting plate 73.

The ejecting pin 71 has a diameter larger than the ejecting pin 72. The ejecting pin 71, as explained later, feeds powder release agent and powder lubricant into the cavity and sleeve.

The ejecting pin 71 is connected to the hydraulic cylinder 77 independent from the hydraulic cylinder 75 fixed behind the movable die plate 3. By driving this hydraulic cylinder 77, without the usual ejection operation (without making the ejecting plate 73 move), the ejecting pin 71 can be made to move in the direction of the arrows B1 and B2 to approach or move away from the moveable die 6. Due to this movement, the front and of the ejecting pin 71 sticks out into or retracts from the recess 6*b* of the movable die 6.

Further, the ejecting plate 73 is connected with a rod 76 of the hydraulic cylinder 75 fixed to the back of the movable die plate 3. By driving this hydraulic cylinder 75, the ejecting plate 73 moves in the direction of the arrows B1 and B2. Due to this, the hydraulic cylinder 77 also moves. Due to the movement of the ejecting plate 73 in the direction of the arrows B1 and B2, the front ends of the ejecting pins 71 and 72 simultaneously stick out into and retract from the recesses 6*b* and 6*a* of the movable die 6.

Figure 2B:
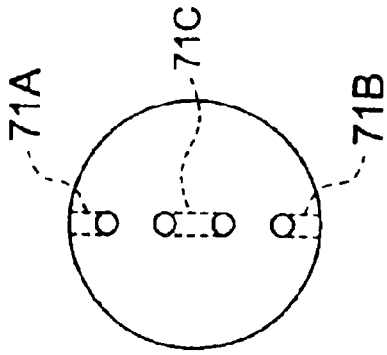
FIG. 2 is a view of the structure of an ejecting pin.
Figure 2A:
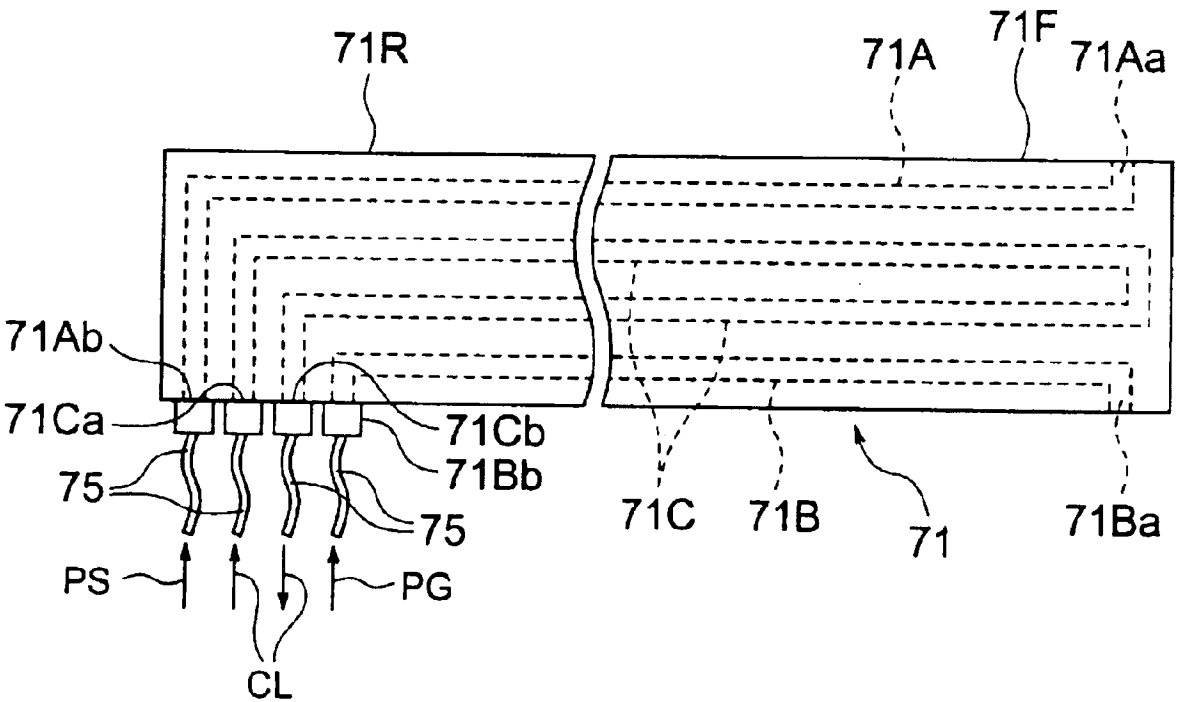

FIG. 2 is a view of the structure of the ejecting pin 71.

As shown in FIG. 2, the ejecting pin 71 is formed with a release agent feed path 71A, a lubricant feed path 71B, and a coolant circulation path 71C from the front end 71F to the rear end 71R of the ejecting pin 71.

The release agent food path 71A is connected at an introduction port 71Ab of the rear end 71R side to the powder feeder 85 through a flexible pipe 75. It is fed the powder release agent PS from this powder feeder 85. The front end 71F side of the release agent feed path 71A is formed with an opening 71Aa opening toward the side face. This opening 71Aa faces the recess 6*a* side of the movable die 6. The powder release agent PS fed through the release agent food path 71A is injected from the opening 71Aa toward the recess 6*a* side of the movable die 6.

The lubricant feed path 71D is connected at the introduction port 71Bb of the rear end 71R side to the powder feeder 85 through the flexible pipe 75. The lubricant feed path 71B is fed the powder lubricant PG from the powder feeder 85. The front end 71F side of this lubricant feeder 71B is formed with an opening 71Ba opening toward the side face. This opening 71Ba faces the sleeve 30 side. The powder lubricant PG fed through the release agent feeder 713 is sprayed from the opening 71B toward the sleeve 30.

The coolant circulation path 71C is formed to guide the coolant CL from the rear end 71R side of the ejecting pin 71 to the front and 717 side, then return it to the rear end 71R. An introduction port 71Ca and the evacuation port 71Cb of the coolant circulation path 71C are connected by the coolant feeder 86 and flexible pipe 75. New coolant CL is fed from the introduction port 71, while the coolant CL circulated through the inside of the ejecting pin 71 passes through the evacuation port 71Cb and is recovered.

The coolant CL used may for example be water. The coolant CL is fed to the ejecting pin 71 at all times during the casting cycle. Due to this, the ejecting pin 71 in prevented from becoming excessively high in temperature.

The powder feeder 85 houses a not shown control valve. This control valve may be operated to feed the powder release agent PS and powder lubricant PG to the ejecting pin 71. This powder feeder 85 for example feeds the powder release agent PS and powder lubricant PG to the ejecting pin 71 by air of a predetermined pressure.

The powder lubricant PS is formed from a powder material. By causing it to deposit on the inner surface of the cavity formed between the fixed die 5 and movable die 6, the molten metal can be prevented from directly contacting the inner surface of the cavity and the release of the casting can be facilitated. By interposition of this powder release agent PS between the inner surface of the cavity and the molten metal, a heat insulating and heat maintaining action are also achieved. The material forming the powder release agent PS may be suitably selected in accordance with the material forming the molten metal.

The powder lubricant PG is comprised of a powder material. By causing it to deposit on the inner circumference of the sleeve 30, friction between the inner circumference of the sleeve 30 and the outer circumference of the plunger 40 fitting into it is reduced. As the material forming the powder lubricant G, for example, talc or another material may be used.

Next, an example of the casting operation by the die casting machine of the above configuration will be explained with reference to FIG. 3 to FIG. 10.

Figure 3:
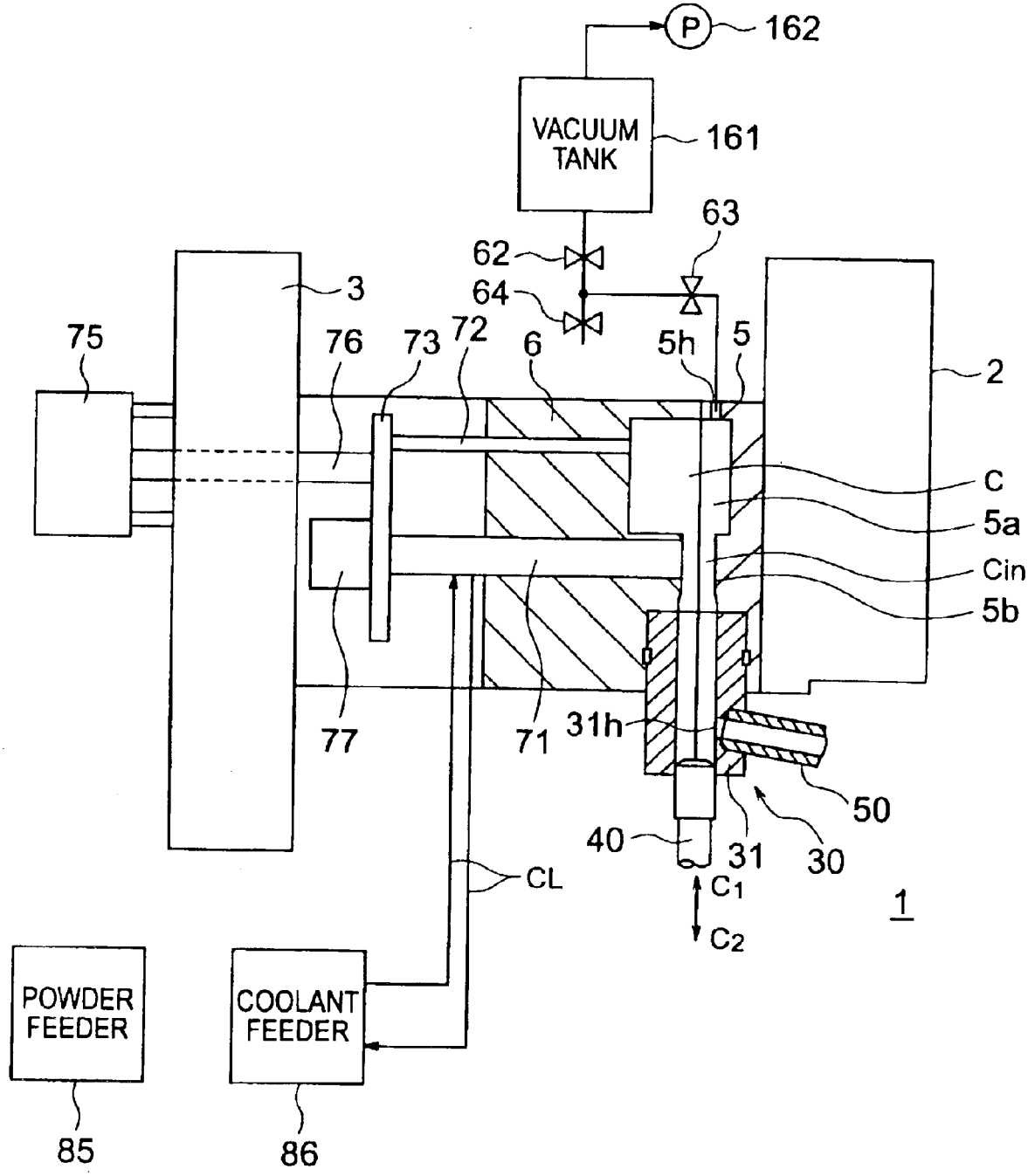
FIG. 3 is a sectional view of an example of a casting operation of a die casting machine of the present invention.

First, as shown in FIG. 3, the movable die plate 3 is made to move in the die closing direction A2 to clamp the fixed die 5 and the movable die 6.

As shown in FIG. 2, when the fixed die 5 and movable die 6 are clamped, the parting faces of the fixed die 5 and movable die 6 cone into close contact and a closed space, that is, the cavity C, is formed and a runner Cin guiding the molten metal to the cavity C is formed between the fixed die 5 and the movable die 6.

Further, by clamping the fixed die 5 and the movable die 6, the parting races of the split part 31 and split part 32 come into close contact, whereby the sleeve 30 is formed by the split parts 31 and 32. This sleeve 30 is communicated with the runner Cin.

Figure 4:
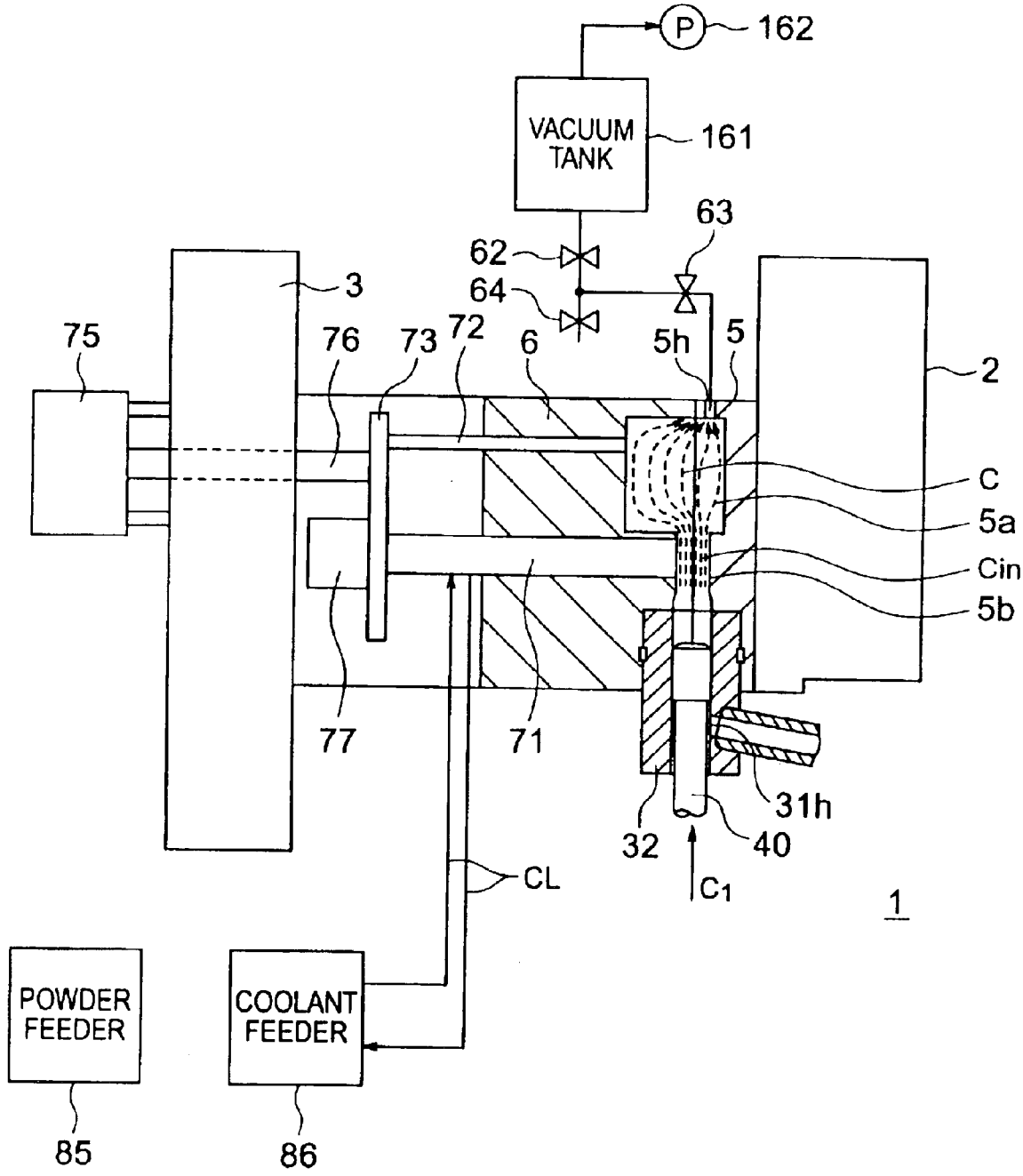
FIG. 4 is a sectional view of an example of a casting operation continuing from FIG. 3.

After the fixed die 5 and the movable die 6 finish being clamped, as shown in FIG. 4, the plunger 40 is made to rise in the vertical direction shown by the arrow C1 and the front end of the plunger 40 (plunger tip) is positioned above the gate 31*h* of the sleeve 30.

Due to this, the sleeve 30 in sealed by the plunger 40, and the cavity C is completely blocked from the outside.

After raising the plunger 40, the control valves 62 and 63 are opened while the control valve 64 is in the closed state. Due to this, air starts to be evacuated from the closed apace formed by the cavity C and part of the sleeve 30 through the evacuation port 5*h* formed at the top end of the fixed die 5.

When evacuation by the vacuum tank 161 starts, the air present in the cavity C, for example as shown by the broken line in FIG. 4, flows toward the evacuation port 5*h*. This flow of air heads from the runner Cin of the cavity C toward the evacuation port 5*h* positioned neat the deepest part of the cavity C.

Figure 5:
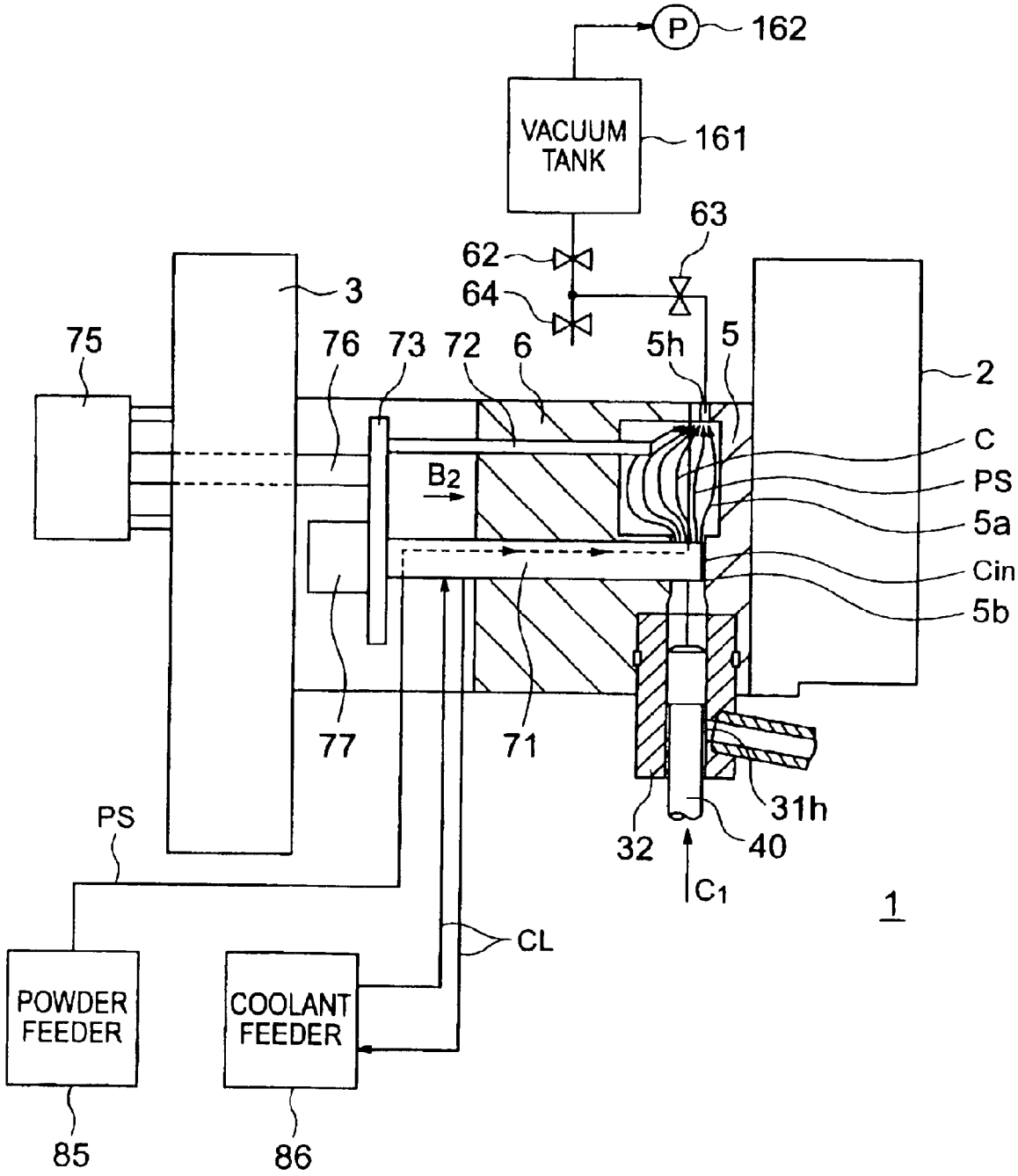
FIG. 5 is a sectional view of an example of a is casting operation continuing from FIG. 4.

Right after evacuation by the vacuum tank 161 starts or right before evacuation starts, as shown in FIG. 5, the hydraulic cylinder 77 is driven and only the ejecting pin 71 is made to stick out into the runner Cin of the cavity C. At this time, the other ejecting pin 72 does not move. Next, the powder feeder 85 feeds the powder release agent PS to the release agent feed path of the ejecting pin 71.

Due to this, the powder release agent PS passes through the release agent feed path of the ejecting pin 71 and is injected toward the cavity C from the opening of the front end of the ejecting pin 71 sticking out into the cavity C. The injected powder release agent PS is rapidly dispersed from the runner Cin of the cavity C toward the deepest part of the cavity C by the flow of air shown in FIG. 4.

Figure 6:
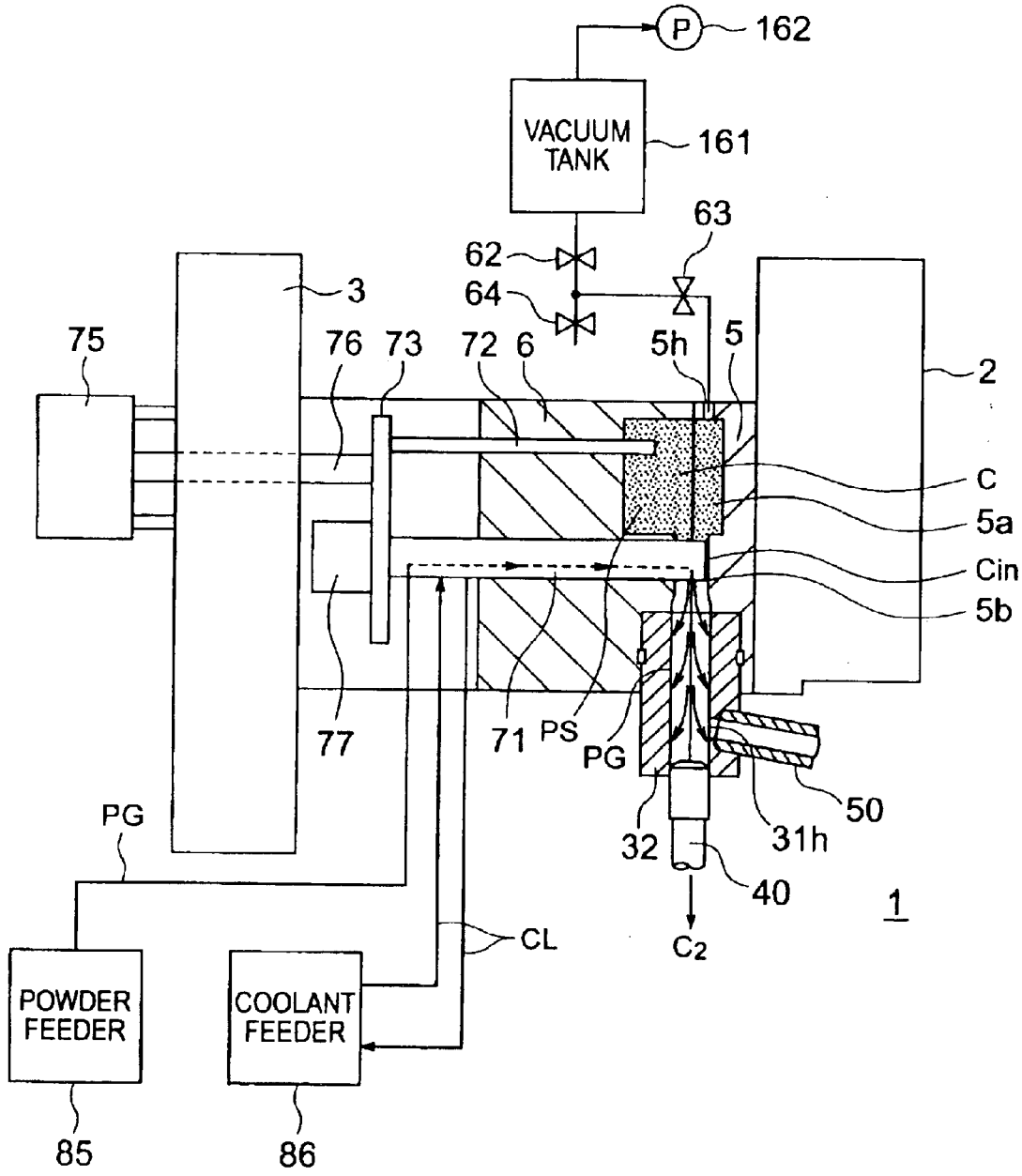
FIG. 6 is a sectional view of an example of a casting operation continuing from FIG. 5.

Due to this, as shown in FIG. 6, the powder release agent PS substantially uniformly disperses inside the cavity C, whereby the powder release agent PS uniformly deposits on the inner surface of the cavity C.

After feeding a predetermined amount of the powder release agent PS, the feeding action of the powder release agent PS from the powder feeder 85 is stopped.

Around when the powder release agent PS finishes being coated on the inner surface of the cavity C, the control valve 64 is closed so as to stop the evacuation of the inside of the cavity C. Due to this, the ambient air rapidly enters the cavity C through the control valves 64 and 63 and the pressure inside the cavity C becomes the ambient pressure.

Next, as shown in FIG. 6, the plunger 40 is made to descend in the direction of the arrow C2 to position the front and of the plunger 40 at a position below the gate 31*h* of the melt feed pipe 50. From this state, the powder lubricant PG is fed from the powder feeder 85 to the lubricant feed path of the ejecting pin PG.

As shown in FIG. 6, the powder lubricant PG is injected front the front end of the ejecting pin 71 toward the sleeve 30, whereby the lubricant PG is coated on the inner circumference or the sleeve 30.

After feeding a predetermined amount of the powder lubricant PG, the feeding action of the powder lubricant PG from the powder feeder 85 is stopped.

Figure 7:
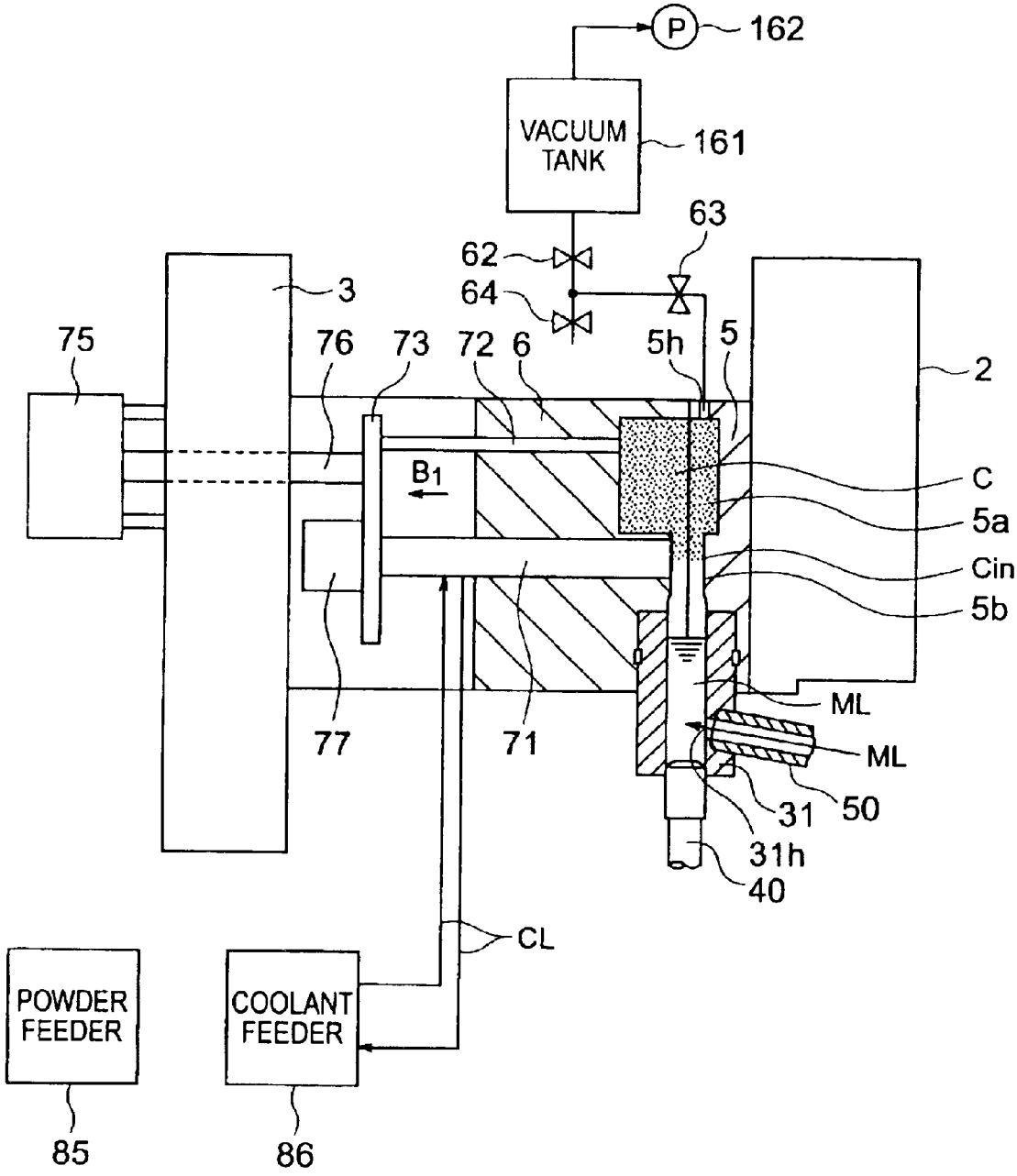
FIG. 7 is a sectional view of an example of a casting operation continuing from FIG. 6.

Around when the powder lubricant PG finishes being coated on the inner circumference of the sleeve 30, as shown in FIG. 7, the hydraulic cylinder 77 is driven to make the front end of the ejecting pin 71 retract into the movable die 6, then feed molten metal ML into the sleeve 30 through the melt feed pipe 50.

Due to this, molten metal ML is housed in the sleeve 30 in a state with the bottom closed by the plunger 40.

Figure 8:
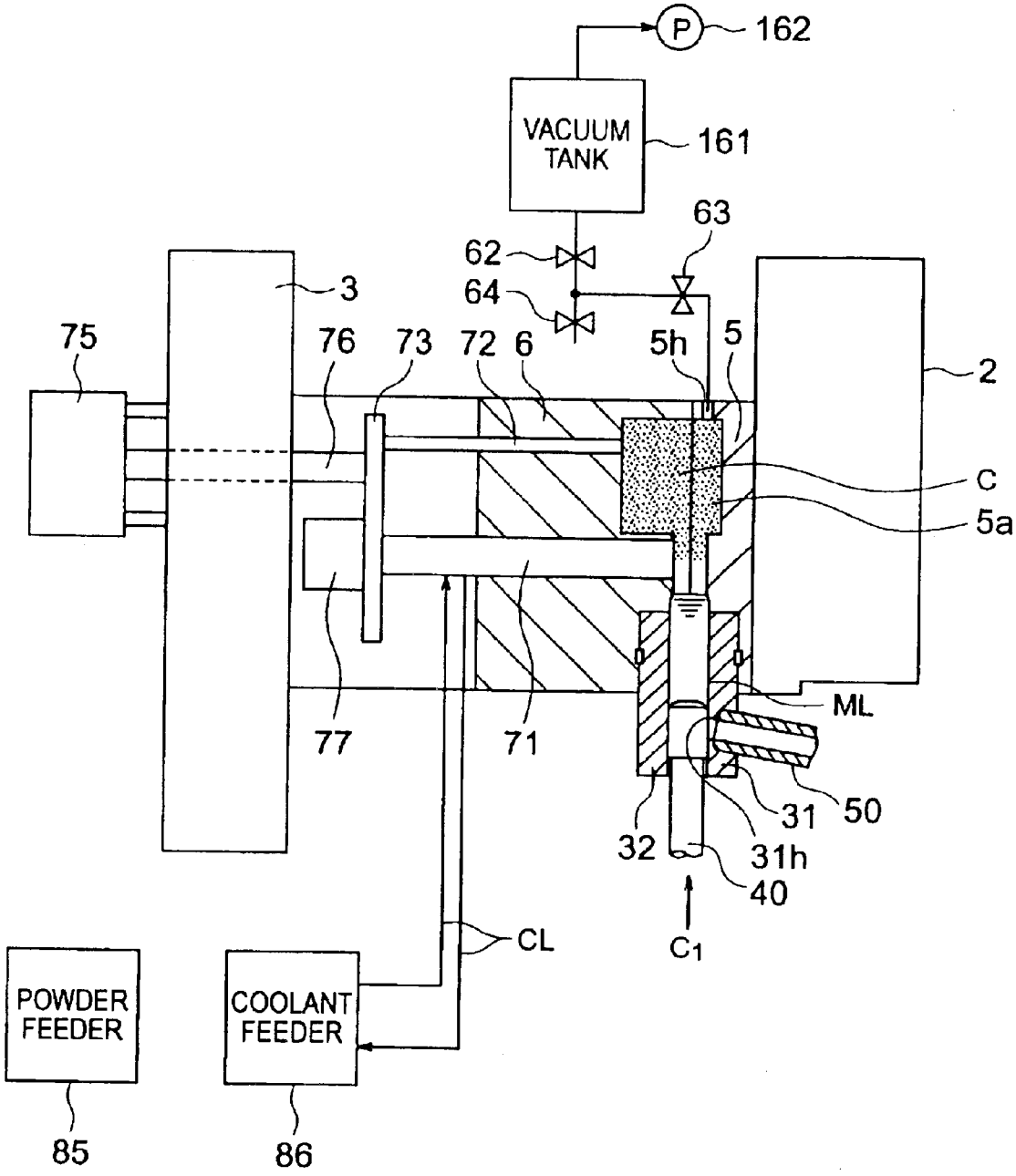
FIG. 8 is a sectional view of an example of a casting operation continuing from FIG. 7.

Next, as shown in FIG. 8, the plunger 40 is made to ascend in the direction of the arrow C1 to move the front end of the plunger 40 to close the gate 31*h* of the sleeve 30.

Figure 9:
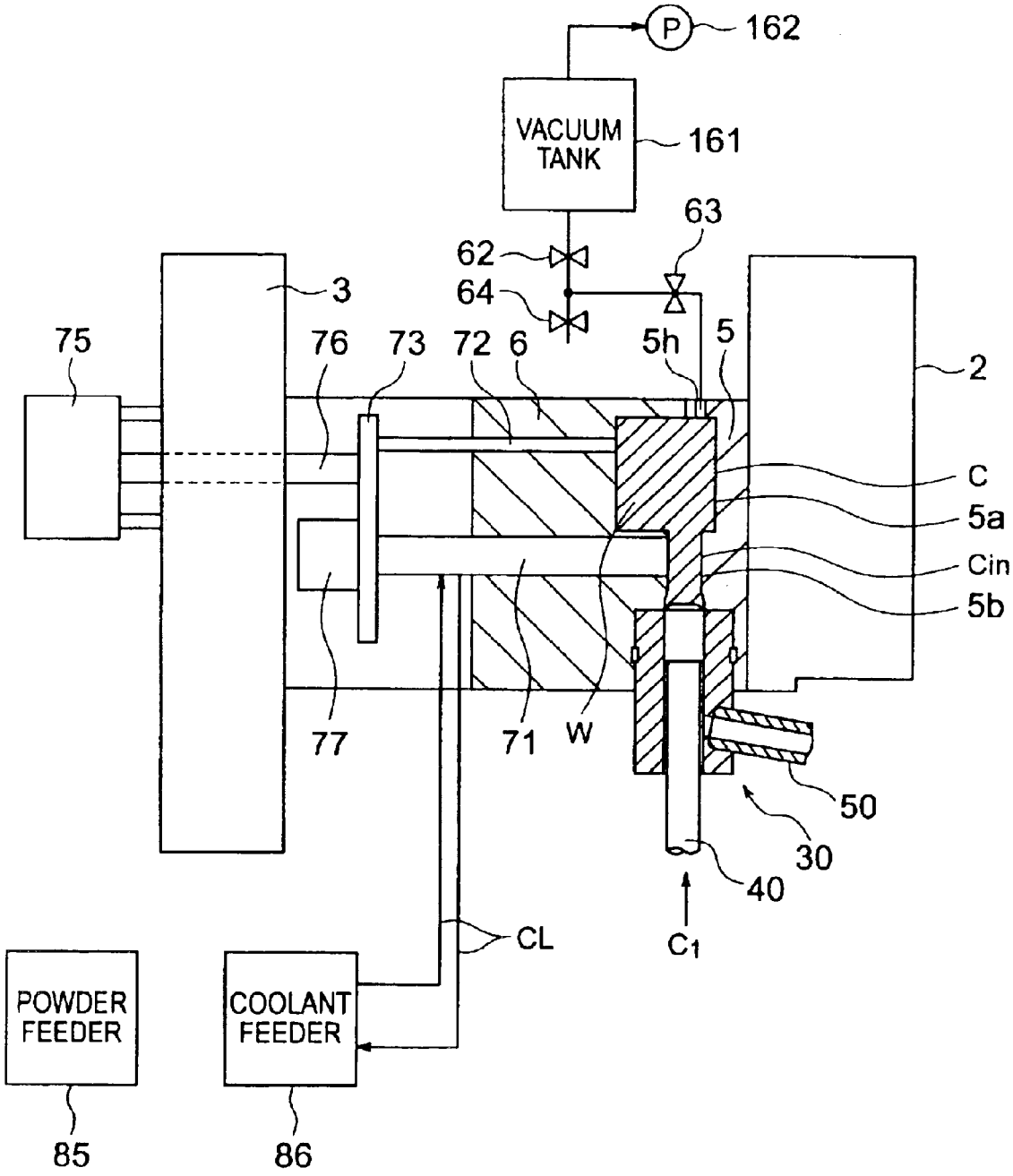
FIG. 9 is a sectional view of an example of a casting operation continuing from FIG. 8.

From this state, as shown in FIG. 9, the plunger 40 is made to move further in the direction of the arrow C1 to inject and fill the molten metal ML housed in the sleeve 30 into the cavity C through the runner Cin. Due to this, the casting W is formed.

Figure 10:
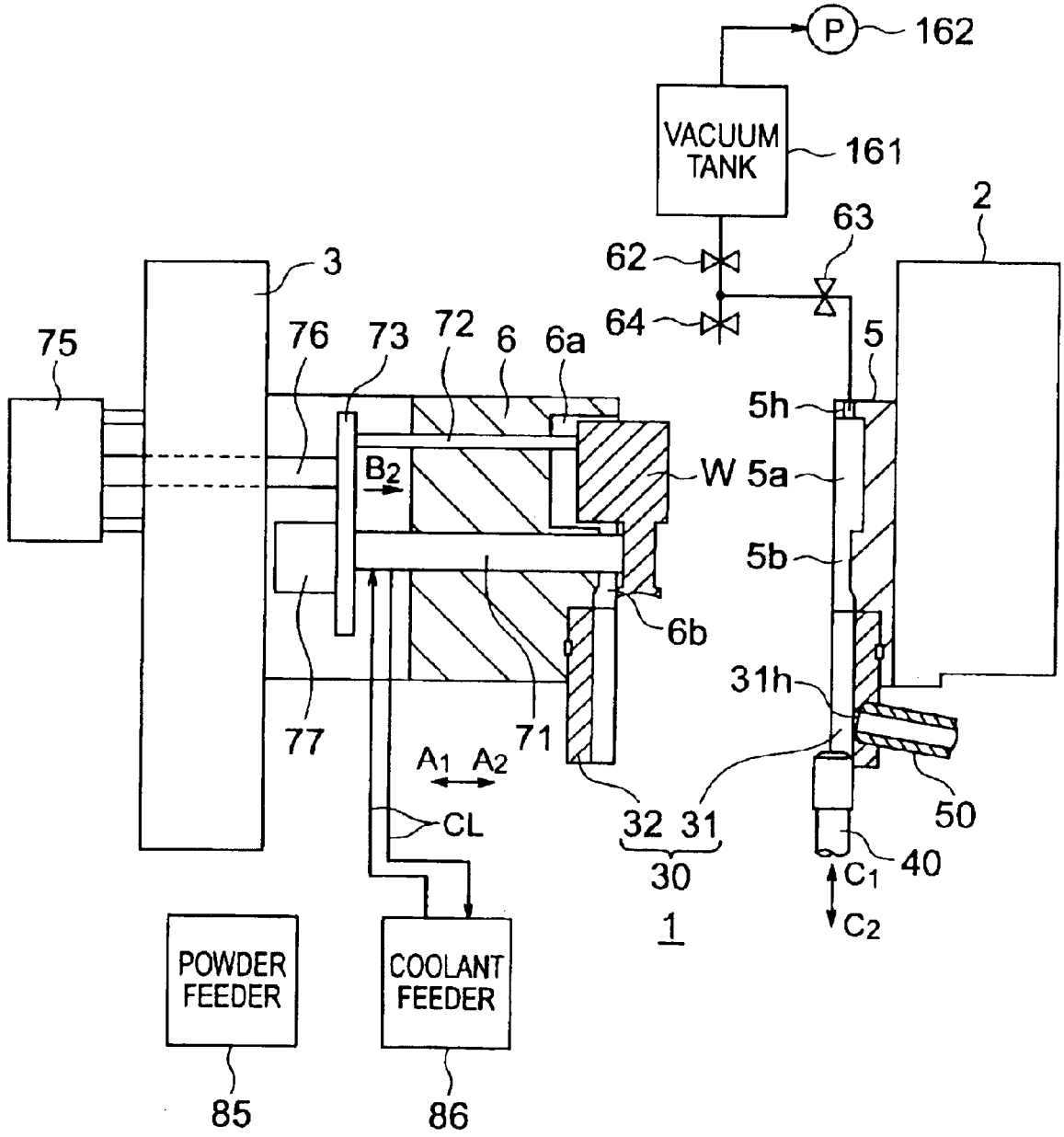
FIG. 10 is a sectional view of an example of a casting operation continuing from FIG. 9.

When the casting W finishes being cast, as shown in FIG. 10, the plunger 40 in made to descend in the direction of the arrow C2, then the movable die plate 3 it moved in the die opening direction A1 and the fixed die 5 and movable die 6 are opened. When the fixed die 5 add movable die 6 are opened, the casting W is released from the fixed die 5 and moves together with the movable die 6.

After moving the movable die plate 3 to a predetermined position, the hydraulic cylinder 75 is driven to make the electing plate 73 move in the direction of the arrow B2 to make the front ends of the ejecting pins 71 and 72 stick out into the recesses 6*a* and 6*b* of the movable die 6 and eject the casting W, whereby the casting is released from the movable die 6.

Due to the above steps, the casting W is obtained.

In this embodiment, in the state with the fixed die 5 and the movable die 6 clamped, the cavity C is evacuated and the flow of air in the cavity C caused by this evacuation is used to make the powder release agent PS sufficiently disperse and deposit on the inner surface of the cavity C. As a result, it becomes possible to uniformly coat the powder release agent PS regardless of the shape of the cavity C etc.

Further, in this embodiment, by arranging the evacuation port 5*h* for evacuating the inside of the cavity C at the deepest part of the cavity C, making the ejecting pin 71 stick out into the runner Cin of the cavity C, and injecting the powder release agent PS from the front end of the ejecting pin 71 toward the cavity C side, it becomes possible to make the powder release agent PS spread to the entire cavity C.

As a result, uneven coating of the powder lubricant PS does not occur and the release and heat insulating performances of the powder lubricant PS can be sufficiently brought out.

Further, in this embodiment, by coating the powder release agent PS, then injecting powder lubricant PG from the front and of the ejecting pin 71 in the state sticking out into the recess 6*b* of the movable die 6 toward the inside of the sleeve 30, the powder lubricant PG can be coated on the entire inner circumference of the sleeve 30.

Further, in this embodiment, the powder feeder 85 for feeding the powder release agent PS and the powder lubricant PG to the ejecting pin 71 is arranged away from the dies 5 and 6, and the powder release agent PS and powder lubricant PG are fed and stopped at the powder feeder 85 side. Therefore, it is not necessary to place control valves and other equipment for injecting the powder release agent PS and powder lubricant PG to the dies 5 and 6, and therefore the configuration becomes extremely simple. The powder feeder 85 is arranged away from the dies 3 and 6 and the sleeve 30, so is not affected by the heat and consequently stable operation can be obtained even if using control valves and other equipment in the powder feeder 85.

The present invention is not limited to the above embodiment.

In the above embodiment, the explanation was given taking as an example a die casting machine of a structure with the sleeve arranged along the vertical direction, but the present invention can also be applied to a die coating machine of a structure with the sleeve arranged along the horizontal direction.

Further in the above embodiment, the explanation was given of the case of feeding both the powder release agent and the powder lubricant, but the invention may also be configured to food only one of the powder release agent or powder lubricant.

Further, in the above embodiment, the explanation was given of the case of coating a powder release agent while reducing the pressure inside the cavity using a vacuum tank 161, but the present invention may also be configured to spray powder release agent from an ejecting pin to cost the inside surface of the cavity without reducing the pressure inside the cavity.

Further, in the above embodiment, the invention was configured to form feed paths for the powder release agent and the powder lubricant in a single ejecting pin, but it is also possible to configure it to form one or both of the feed paths for the powder release agent and the powder lubricant in a plurality of ejecting pins. In this case, it is preferable to suitably adjust the injection directions of the powder release agent and the powder lubricant of the different ejecting pins.

Further, in the above embodiment, the invention was configured to provide a hydraulic cylinder 77 for driving the ejecting pin 71 and a hydraulic cylinder 75 for driving the ejecting pin 73, but it may also be configured to not provide a hydraulic cylinder 77, but make the front end of the ejecting pin 71 stick out into the cavity by being driven by an ejecting plate 73 at the time of injection of the powder.

Second Embodiment

Figure 11:
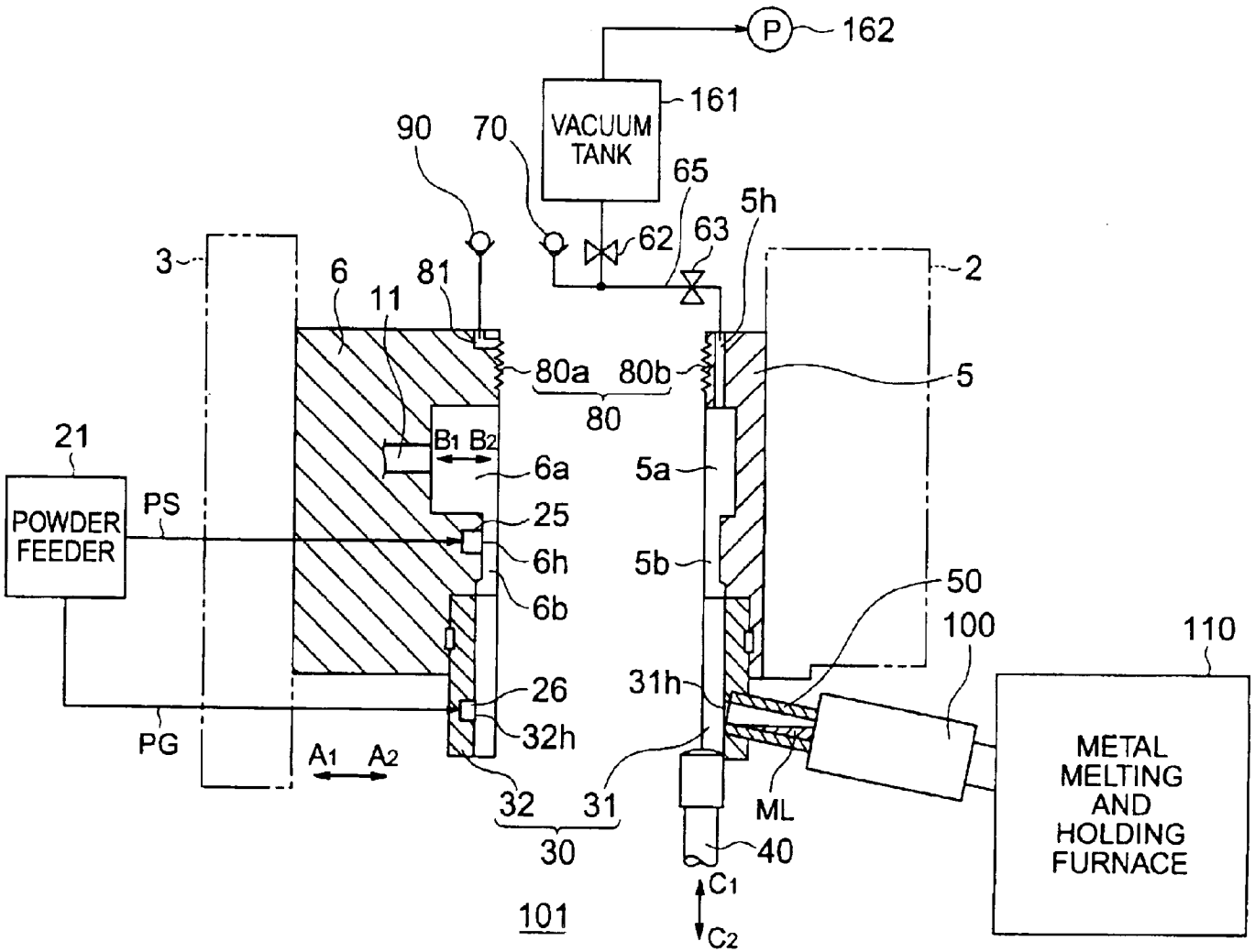
FIG. 11 is a sectional view in a vertical direction showing the configuration of a die casting machine according to another embodiment of the present invention.

FIG. 11 is a sectional view along the vertical direction showing the configuration of principal parts of a die casting machine according to another embodiment of the present invention. Note that in FIG. 11, components the same as in the first embodiment are assigned the same reference numerals.

In FIG. 11, a die canting machine 101 is provided with a fixed die 5, a movable die 6, a sleeve 30 comprised of a split part 31 and a split part 32, a plunger 40, a melt feed pipe 50, a powder feeder 21, a vacuum tank 161, an electromagnetic pump 100 for feeding the sleeve 30 with molten metal ML through the melt feed pipe 50 connected to the split part 31 of the sleeve 30, and a metal melting and holding furnace 110 for holding the molten metal ML to be fed to the melt feed pipe 50.

Further, the die casting machine 101 has a check valve 70 provided between an evacuation path connecting the vacuum tank 161 and fixed die 5 and the outside of the die.

Further, the die casting machine 101 has a check valve 90 provided between a chill-vent 80 provided between the dies 5 and 6 and the outside or the dies.

The check valves 70 and 90 form the gas evacuating means of the present invention.

The fixed die 5 is formed with a recess 5*a* for forming a cavity in which a molten metal is to be filled and a recess 5*b* for forming a runner for guiding the molten metal to this cavity.

The movable die 6 is provided with a squeeze pin 11 for applying local pressure right before solidifying the molten metal filled into the cavity. This is provided to be able to stick out into and retract from a recess 6*a* in the direction shown by the arrows B1 and B2. This squeeze pin 11 is provided to prevent sinks from occurring in the casting or prevent blow holes from occurring inside the casting. The squeeze pin 11 is provided behind the moveable die 6 and is driven by a not shown hydraulic cylinder or other drive source.

Note that the movable die 6 is also provided with a not shown ejecting pin for ejecting the casting.

Further, the parting faces of the movable die 6 and the fixed die 5 are formed with grooves 80*a* and 80*b* for forming the chill-vent 80.

The chill-vent 80 functions as an evacuation path for evacuating the inside of the cavity formed between the movable die 6 and the fixed die 5 when molten metal is injected and filled into the cavity. Further, the flow path of the chill-vent 80 is narrow and long, so even if the molten metal enters the chill-vent 80, the molten metal will solidify in the middles of the flow path of the chill-vent at and will never be discharged outside of the dies.

The chill-vent 80 is communicated with an evacuation path 81 formed in the movable die 6. This evacuation path 81 is connected with a check valve 90.

The check valve 90 prevents the inflow of ambient air into the evacuation path 81 and allows passage of the gas evacuated from the cavity side through the chill-vent 80. That is, when the inside of the cavity C is being reduced in pressure, it prevents inflow of the ambient air into the cavity C, while when a pressure difference is produced between the pressure inside the cavity C and the ambient pressure, it automatically operates to evacuate the gas inside the cavity.

Note that the check valve 90 used is preferably one of as large a caliber as possible.

The melt food pipe 50 is connected to the split part 31 fixed to the fixed die 3. This melt feed pipe 50 connects the metal melting and holding furnace 110 and the sleeve 30.

The metal melting and holding furnace 110 molts and holds the metal. This metal melting and holding furnace 110 has a not shown liquid surface height adjusting mechanism for adjusting the height of the liquid surface of the molten metal in the melt feed pipe 50, inclined by a predetermined angle from the split part 31 of the sleeve 30, so that the height becomes constant at all times.

The electromagnetic pump 100 guides the molten metal, guided up to the middle of the malt feed pipe 50, to the sleeve 30 by electromagnetic action. By driving and controlling the electromagnetic pump 100, a predetermined amount of the molten metal is fed into the sleeve 30 through the gate 31*h* formed at the split part 31 of the sleeve 30.

The powder feeder 21 is connected to a control valve 25 provided at the movable die 6 and a control valve 26 provided at the split part 32 of the sleeve 30. The powder feeder 21 feeds powder release agent PS to the control valve 25 side and feeds powder lubricant PG to the control valve 26 side.

The control valve 25 opens and closes the injection port 6*h* formed at the recess 6*b* of the movable die 6. By the control valve 25 opening the injection port 6*h*, the powder release agent Ps fed from the powder feeder 21 is injected into the cavity.

The control valve 26 opens and closes the injection port 32*h* formed at the split part 32 of the sleeve 30. By the control valve 26 opening the injection port 32*h*, the powder lubricant PG fed from the powder feeder 21 is injected into the sleeve 30.

Between the control valve 62 and the control valve 63 provided in the middle of the evacuation pipe 65 connecting the vacuum tank 161 and the fixed die 5 is provided a check valve 70 with the ambient air.

The check vale 70 prevents the inflow of ambient air into the evacuation pipe 65 when the pressure inside the evacuation pipe 65 in lower than ambient pressure. When the pressure inside the evacuation pipe 65 is higher than ambient pressure, the check valve 70 allows outflow of the gas from the exhaust pipe 65 to the outside through it. That in, it automatically operates by the pressure difference caused between the cavity C and the outside of the die.

Note that the check valve 70 used is preferably one of as large a caliber as possible.

Next, an example of a casting operation by the die casting machine 101 of this configuration will be explained with reference to FIG. 12 to FIG. 18.

Figure 12:
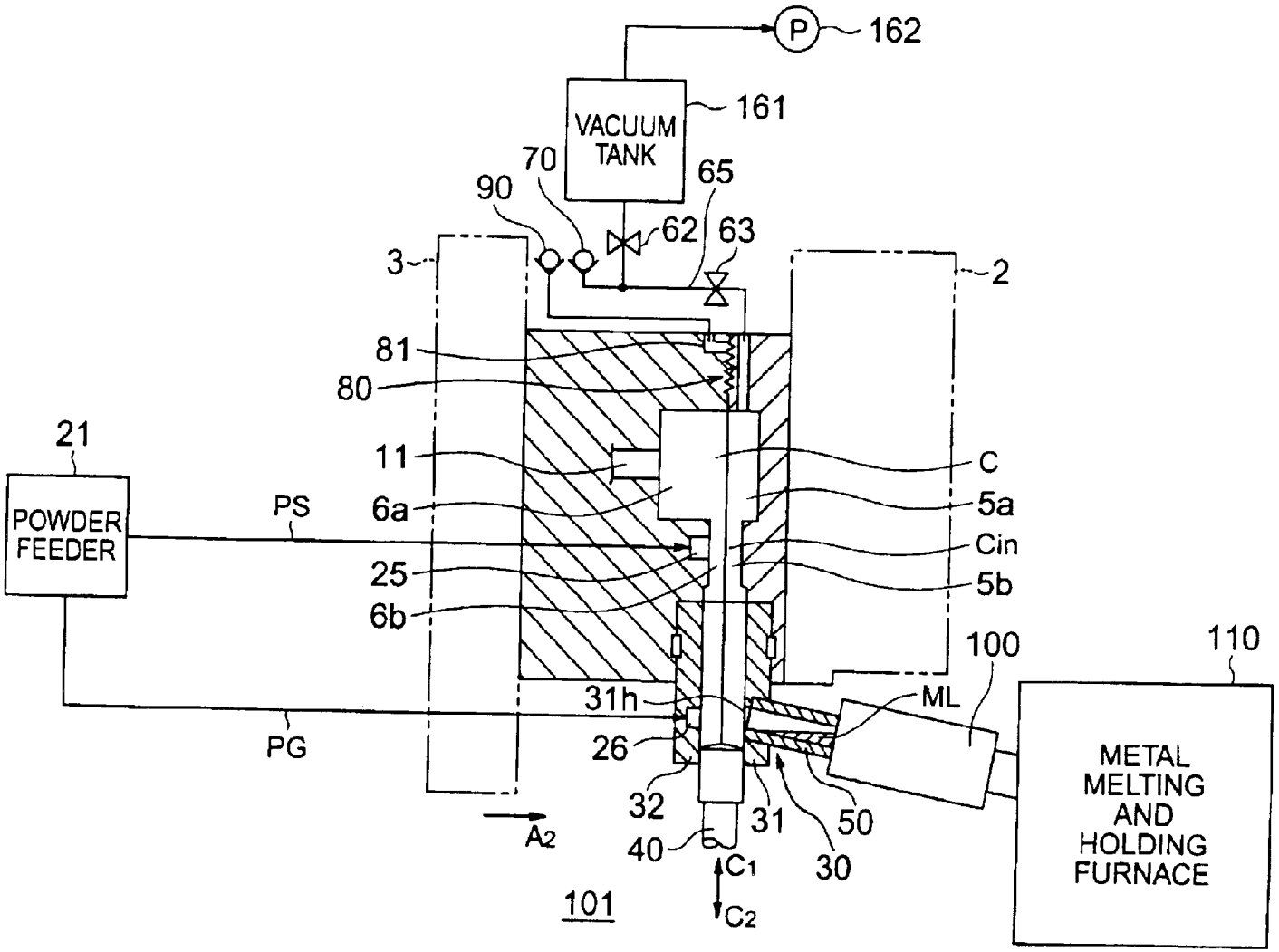
FIG. 12 is a sectional view of an example of a casting operation of a die casting machine shown in FIG. 11.

First, as shown in FIG. 12, the movable die plate 3 is made to move in the die closing direction A2 to clamp the fixed die 5 and the movable die 6.

As shown in FIG. 12, when the fixed die 5 and movable die 6 are clamped, the parting faces of the fixed die 5 and movable die 6 come into close contact, whereby a closed space, that is, the cavity C is formed and a runner Cin for guiding the molten metal to the cavity C is formed.

Further, by the clamping of the fixed die 3 and movable die 6, the parting faces of the split part 31 and split part 32 come into close contact, whereby the split parts 31 and 32 form the sleeve 30. This sleeve 30 is communicated with the runner Cin.

Note that in this state, the molten metal ML is fed into the melt feed pipe 50 so as to reach a predetermined height of liquid surface. The liquid surface of the molten metal ML and the inner surface of the cavity C and inner circumference of the sleeve 30 form a closed space.

Figure 13:
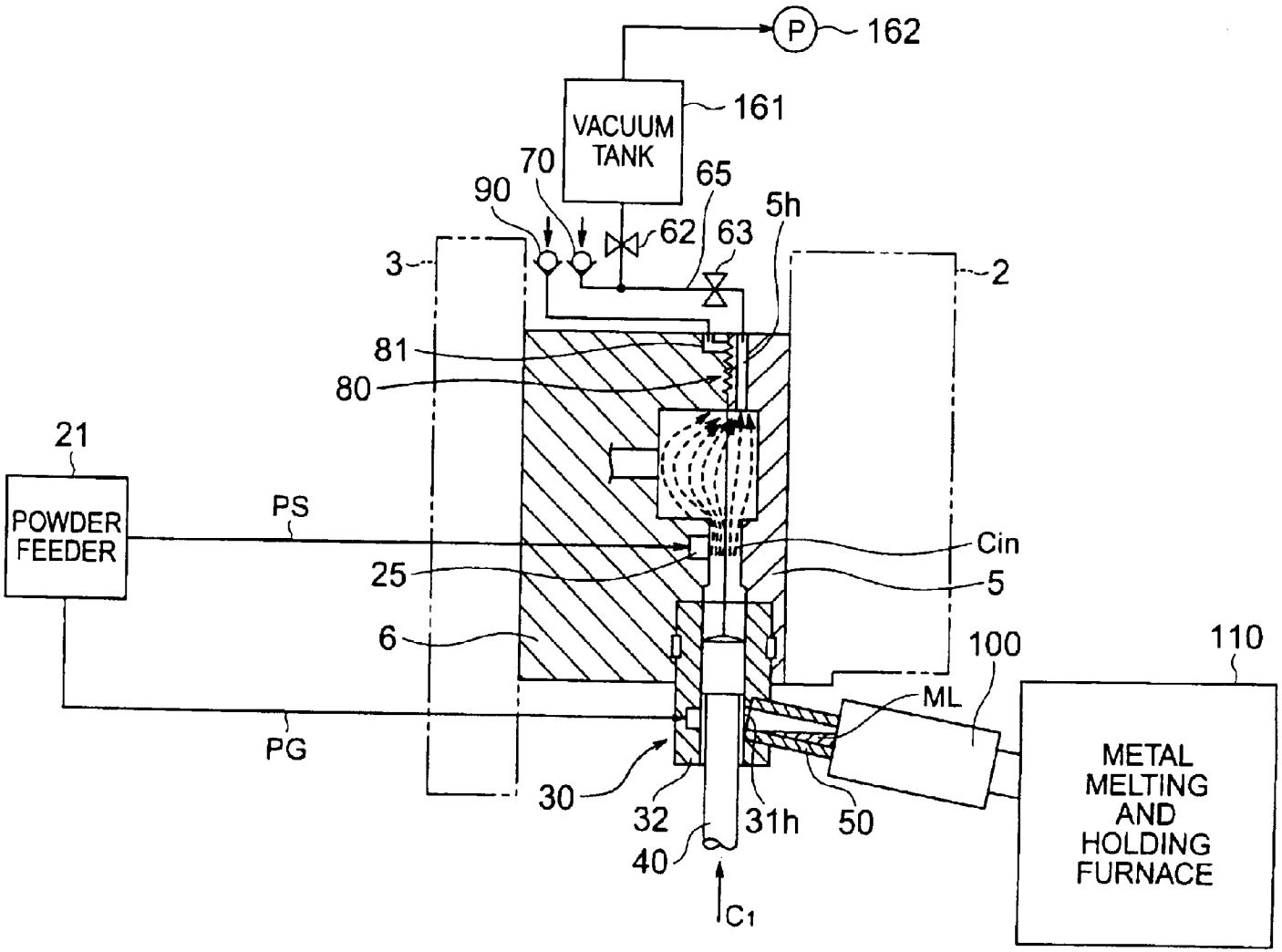
FIG. 13 is a sectional view of an example of a casting operation continuing from FIG. 12.

After the fixed die and the movable die 6 finish being clamped, as shown in FIG. 13, the plunger 40 is made to rise in the vertical direction shown by the arrow C1 to position the front end of the plunger 40 (plunger tip) above the gate 31*h* of the sleeve 30.

Due to this, the sleeve 30 is sealed by the plunger 40, and the cavity C in completely blocked from the outside.

After the plunger 40 is made to rise, the control valves 62 and 63 are opened. Due to this, air starts to be evacuated by the vacuum tank 161 from the closed space formed by the cavity C and part of the sleeve 30 through the evacuation port 5*h* formed at the top and of the fixed die 5.

At this time, the cavity C and the sleeve 30 are reduced in pressure, so the ambient air tries to enter them through the chill-vent 80, but this is prevented by the check valve 90.

Further, the pressure inside the evacuation pipe 65 also becomes lower than ambient pressure, so the ambient air tries to flow into the evacuation pipe 65, but this is prevented by the check valve 70.

When the evacuation by the vacuum tank 161 is started, the air present inside the cavity C flows toward the evacuation port 5*h* as shown by the broken line in FIG. 13 for example. This flow of air heads from the runner Cin of the cavity toward the evacuation port 5*h* positioned near the deepest part of the cavity C.

After evaluation by the vacuum tank 16 starts, the control valve 25 is opened to inject the powder release agent PS from the injection port 6*h*.

When the powder release agent Ps is injected from the injection port 6*h*, the power release agent PS rapidly disperses from the runner Cin of the cavity C toward the deepest part of the cavity C due to the flow of air shown in FIG. 13.

Figure 14:
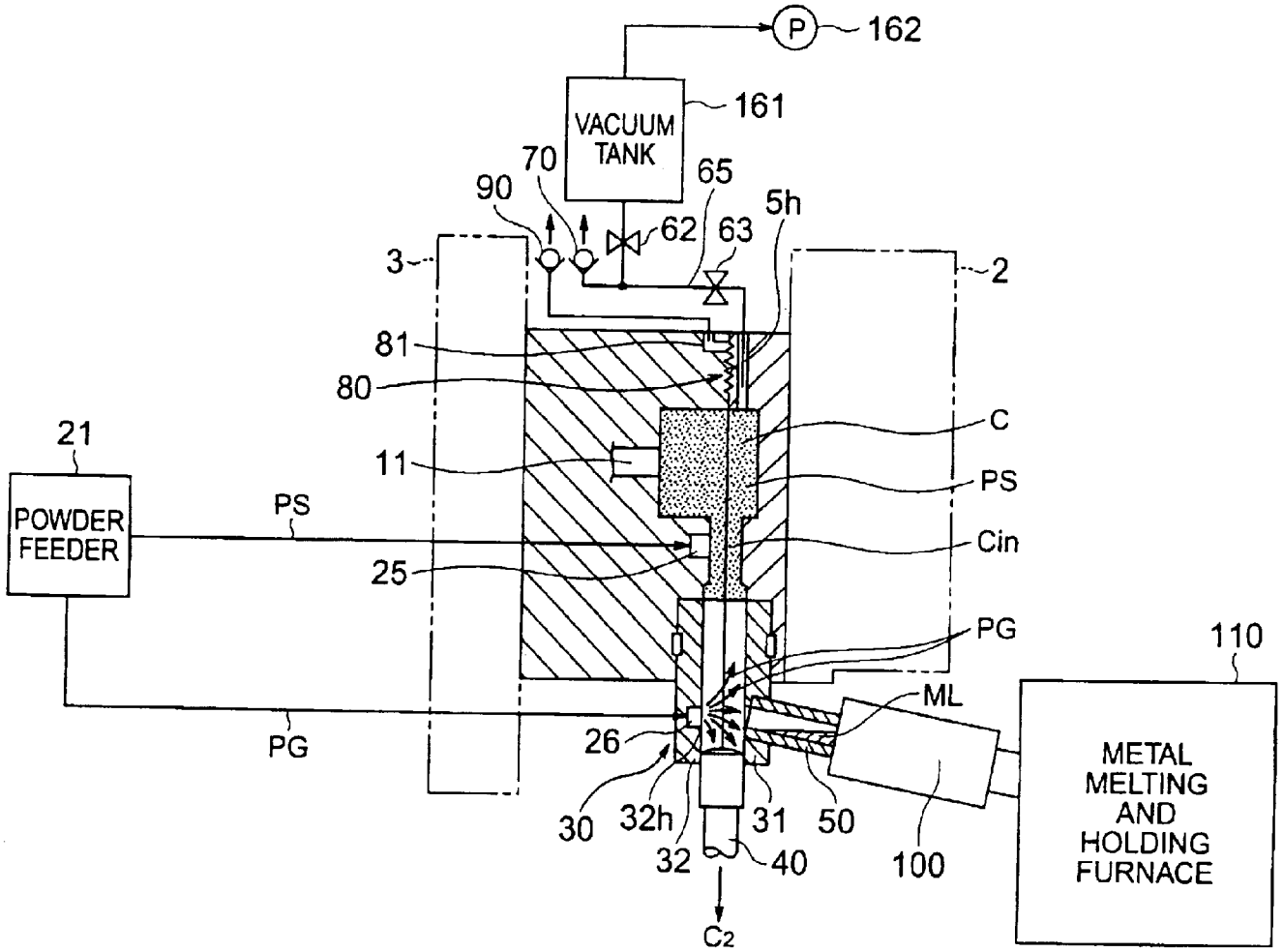
FIG. 14 is a sectional view of an example of a casting operation continuing from FIG. 13.

Due to this, an shown in FIG. 14, the powder release agent PS uniformly disperses in the cavity C, whereby the powder release agent PS uniformly deposits on the inner surface of the cavity C.

Around then the powder release agent PS finish is being coated on the inner surface of the cavity C, only the control valve 62 is closed so as to stop the evacuation of the inside of the cavity C.

Due to this, when evacuation is stopped, the ambient air rapidly enters the cavity C from the clearance and the pressure inside the cavity C becomes close to ambient pressure or becomes ambient pressure.

Next, as shown in FIG. 14, the plunger 40 is made to descend in the direction of the arrow C2 to position the front end of the plunger 40 at a position below the injection port 32*h* of the sleeve 30. From this state, the control valve 26 is opened and the powder lubricant PG is injected from the injection port 32*h* into the sleeve 30.

Due to this, the powder lubricant G is coated on the inner circumference of the sleeve 30.

At this time, since the powder lubricant PG is injected from the injection port 32*h* to the inside of the sleeve 30, the pressure inside the cavity C and the sleeve 30 risen temporarily. Further, if the pressure inside the cavity C and the sleeve 30 rises, the pressure acts as a force pushing down the liquid surface of the molten metal ML in the melt feed pipe 50.

Here, in the present embodiment, since check valves 90 and 70 are connected to the chill-vent 80 and the evacuation port 5*h*, the gas inside the cavity C and the sleeve 30 is evacuated to the outside of the dies 5 and 6 through these check valves 90 and 70. As a result, there is almost no force pushing down the liquid surface of the molten metal ML in the melt feed pipe 50 and the liquid surface of the molten metal ML in the melt feed pipe 50 is prevented from fluctuating.

Figure 15:
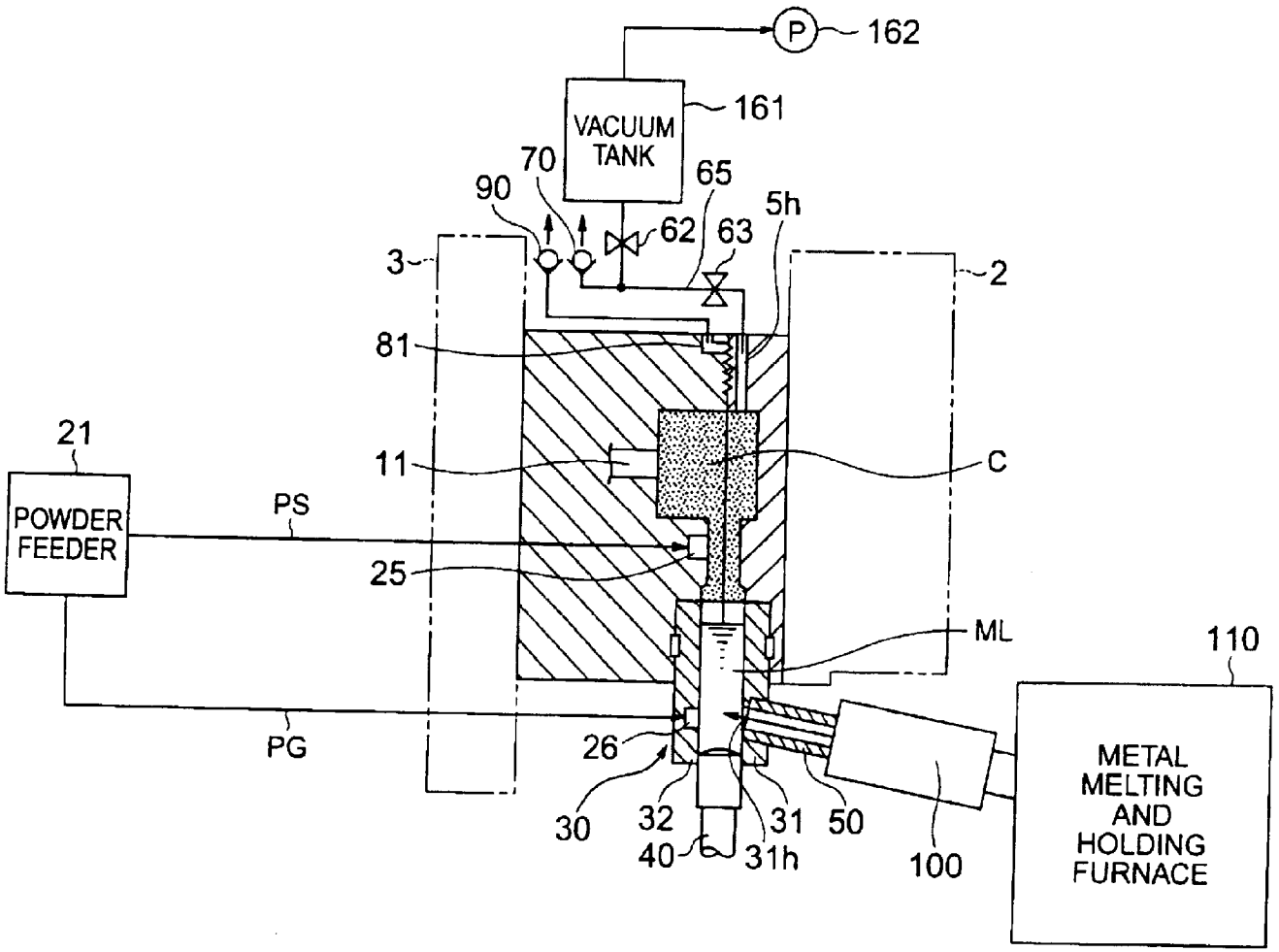
FIG. 15 is a sectional view of an example of a casting operation continuing from FIG. 14.

After the powder lubricant PG finishes being coated on the inner circumference of the sleeve 30, as shown in FIG. 15, the molten metal ML is fed inside the sleeve 30 through the melt feed pipe 50.

Due to this, the molten metal ML is housed inside the sleeve 3 in a state with the bottom closed by the plunger 40.

Here, since the liquid level of the molten metal ML in the melt feed pipe 50 will not fluctuate, accurately measured molten metal ML will be fed into the sleeve 30 by the electromagnetic pump 100.

When the molten metal ML is fed to the inside of the sleeve 30, the volume of the closed space formed by the sleeve 30 and the cavity C in reduced by the amount of the fed molten metal ML and a volume of gas of that reduced volume is evacuated to the outside from the check valves 70 and 90.

Figure 16:
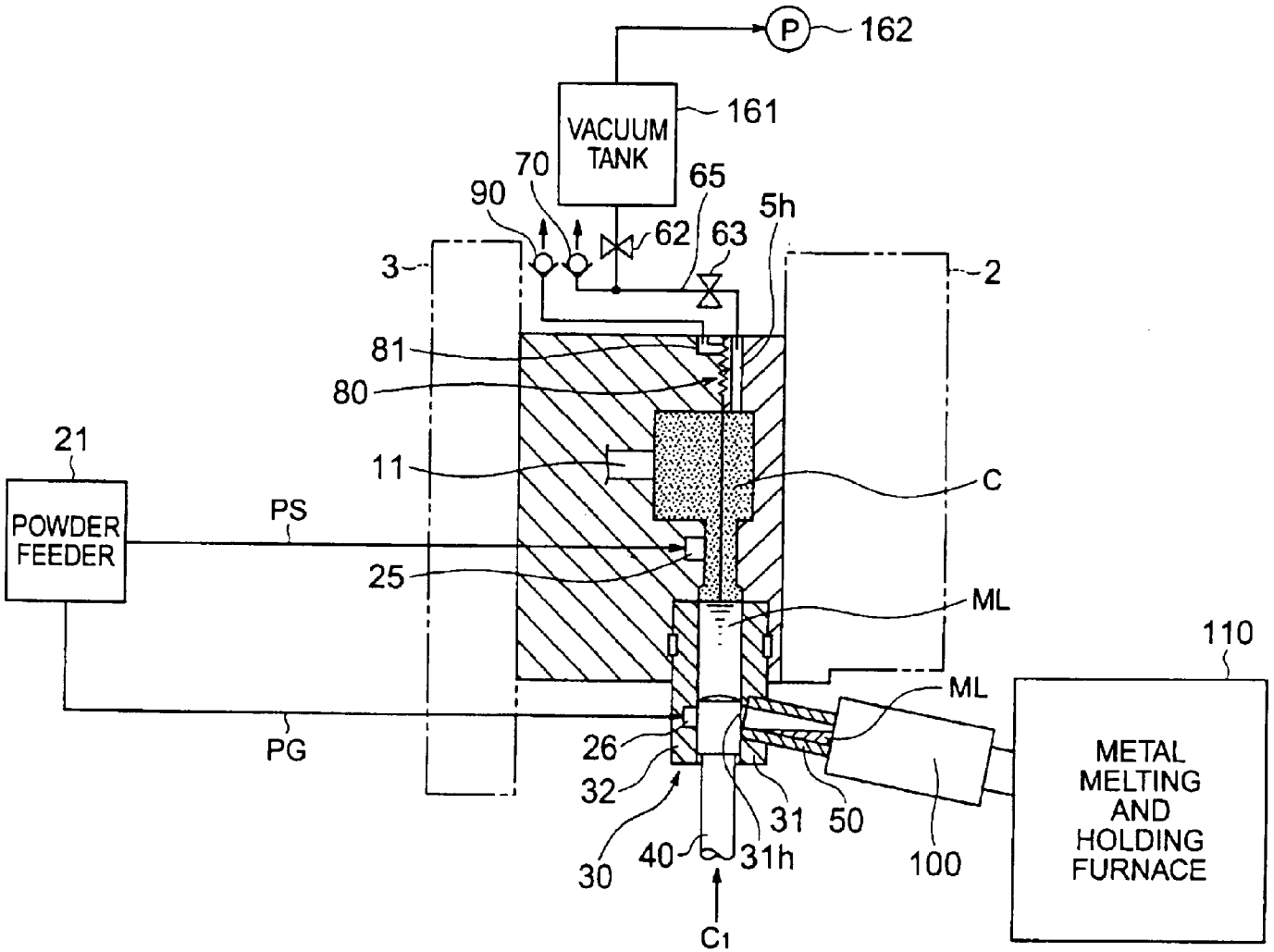
FIG. 16 is a sectional view of an example of a casting operation continuing from FIG. 15.

Next, as shown in FIG. 16, the plunger 40 is made to rise in the direction of the arrow C1 to make the front end of the plunger 40 move to a position blocking the gate 31*h* of the sleeve 30. In this case as well, an amount of gas corresponding to the amount of rise of the plunger 40 is evacuated to the outside from the check valves 70 and 90.

Further, at this position, the control valve 63 is closed. Due to this, there is no longer leakage of the molten metal to the vacuum tank 161 side.

Figure 17:
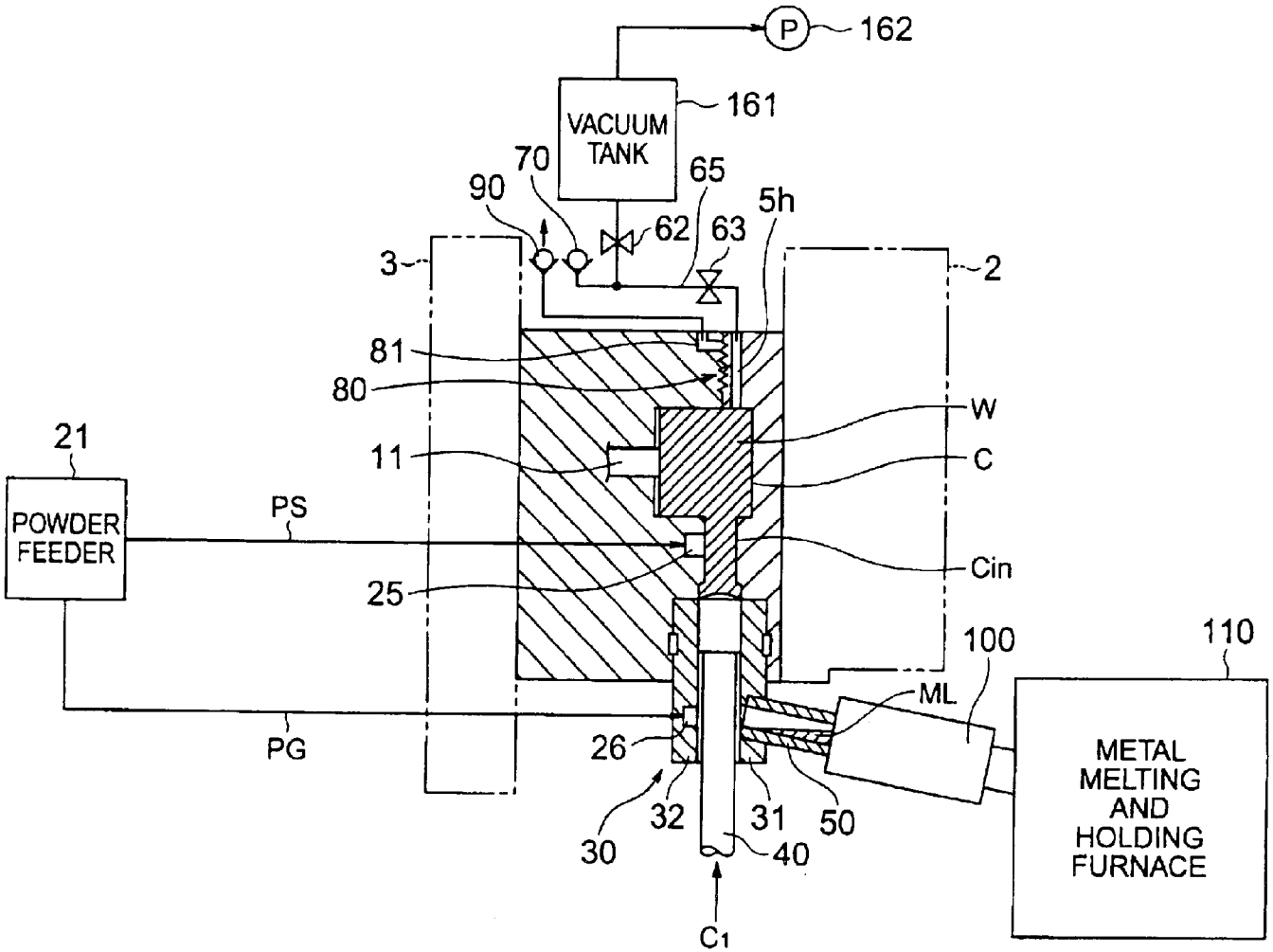
FIG. 17 is a sectional view of an example of a casting operation continuing from FIG. 16.

From this state, as shown in FIG. 17, the plunger 40 is made to move further in the direction of the arrow C1 to inject and fill the molten metal housed in the sleeve 30 through the runner Cin to the inside of the cavity C.

At this time, gas in evacuated to the outside from only the cheek valve 90 in an amount of exactly the injection and filling of the molten metal ML in the cavity C.

Further, after the molten metal ML is injected and filled into the cavity C, before the molten metal ML solidifies, the squeeze pin 11 is made to stick out to pressurize the molten metal ML filled in the cavity C. Due to this, a casting W reduced in occurrence of sinks or blow holes is cast.

Figure 18:
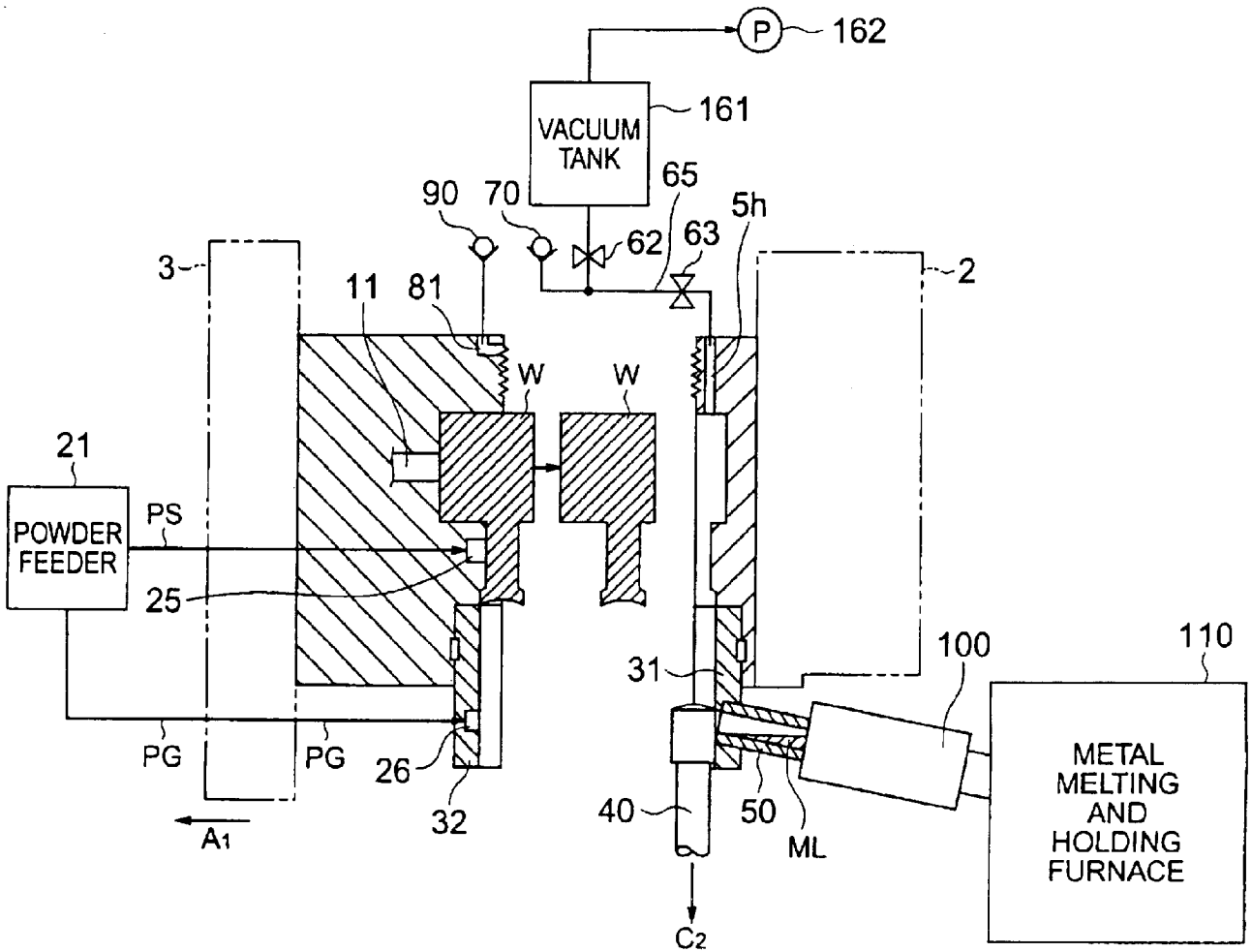
FIG. 18 is a sectional view of an example of a casting operation continuing from FIG. 17.

When the product finishes being cast, as shown in FIG. 18, the plunger 40 in made to descend in the direction of the arrow C2, then the movable die plate 3 is moved in the die opening direction A1 and the fixed die 5 and movable die 6 are opened. When the fixed die 5 and movable die 6 are opened, the casting W is released from the fixed die 5 and moves together with the movable die 6.

After moving the movable die plate 3 to a predetermined position, the not shown ejecting pins are operated to release the casting W from the movable die 6.

Due to the above steps, the casting W is obtained.

In this embodiment, in the state with the fixed die 5 and the movable die 6 clamped, the cavity C is evacuated and the flow of air in the cavity C caused by this evacuation is used to make the powder release agent PS sufficiently disperse and deposit on the inner surface of the cavity C. As a result, it becomes possible to uniformly coat the powder release agent PS regardless of the shape of the cavity C etc.

Further, in this embodiment, by arranging the evacuation port 5*h* for evacuating the inside of the cavity C et the deepest part of the cavity C and arranging the injection port 6*s* of the powder release agent PS at the runner Cin of the cavity C, it becomes possible to make the powder release agent PS spread to the entire cavity C.

As a result, uneven coating of the powder lubricant PS does not occur and the release and heat insulating performances of the powder lubricant PS can be sufficiently brought out.

Further, in this embodiment, since a chill-vent 80 is provided at the parting faces of the dies 5 and 6 and a check valve 90 is provided between this chill-vent 80 and the ambient air, then reducing the pressure by the vacuum tank 161, it is possible to prevent the ambient air from flowing into the cavity C from the chill-vent 80 and possible to reliably reduce the pressure.

Further, in this embodiment, by providing a check valve 70 in the middle of the exhaust pipe 65 connecting the vacuum tank 161 and cavity C in addition to the check valve 90, when injecting powder lubricant PG into the sleeve 30, the pressure in the cavity C and the sleeve 30 rises and the liquid surface of the molten metal ML in the melt feed pipe 50 is pushed down, whereby it is possible to prevent the height of the liquid surface from fluctuating. Due to this, it is possible to feed an accurate amount of the molten metal ML to the inside of the sleeve 30 by the electromagnetic pump 100. As a result, fluctuations in quality of the castings are made harder to occur and the quality can be improved.

Further, by using a check valve rather than a control valve to evacuate the inside of the cavity, it is possible to make it automatically operate by the pressure difference between the pressure inside the cavity C and the sleeve 30 and the ambient pressure, possible to streamline the structure, and possible to improve the response.

While the invention has been described with reference to specific embodiment chosen for purpose of illustration, it should be apparent that numerous modifications could be made thereto by those skilled in the art without departing from the basic concept and scope of the invention.

What is claimed is:

1. A die casting machine, comprising:

a fixed die having first and second recessed portions;

a movable die having third and fourth recessed portions;

a sleeve having a first split sleeve connected to the second recessed portion and a second split sleeve connected to the fourth recessed portion;

a first movable ejecting pin having a first opening, a second opening, an end, a release agent feed path, and a lubricant feed path, the first opening formed at a portion adjacent to the end and connected to the release agent feed path, the second opening formed at a portion adjacent to the end and connected to the lubricant feed path;

a first ejecting pin driver for moving the first ejecting pin; and a controller, (a) wherein, when the fixed die and the movable die are clamped together:

(i) the first recessed portion and the third recessed portion define a cavity, (ii) the second recessed portion and the fourth recessed portion define a first path for guiding a molten metal into the cavity, (iii) the first and second split sleeves define a second path for introducing the molten metal to the cavity through the first path, (iv) the fourth recessed portion defines a hole though which the first ejecting pin is configured to pass;

(v) the first opening of the first ejecting pin is directed toward the cavity while the second opening of the first ejecting pin is directed towards the second path; and (b) wherein, when the fixed die and the movable die are clamped together, the controller:

(i) drives the first ejecting pin driver to move the end of the first ejecting pin into the first path, (ii) feeds a powder release agent to the release agent feed path, injects the powder release agent through the first opening into the cavity to deposit the powder release agent on the inner surface of the cavity, (iii) feeds a powder lubricant to the lubricant feed path, injects the powder lubricant through the second opening into the second path to coat the inner circumference of the second path of the sleeve, (iv) drives the first ejecting pin driver to move a face of the end of the first ejecting pin into alignment with the inner wall of the first path to form a molten metal guide path, and (v) after completing a casting, drives the first ejecting pin driver to push the first ejecting pin into the casting to separate the movable die from the casting.

2. The die casting machine of claim 1, further comprising:

a second ejecting pin; and a second ejecting pin driver for moving the second ejecting pin, wherein the third recessed portion defines a hole through which the second ejecting pin is designed to pass such that, after completing the casting, the second ejecting pin is driven t into the casting to separate the fixed die from the casting.

3. The die casting machine of claim 1, further comprising:

an evacuator for reducing the pressure in the cavity when the fixed and movable dies are clamped together, wherein the control means reduces the pressure, feeds the powder release agent through the first ejecting pin into the cavity and disperses the powder release agent on an inside surface of the cavity by a flow of air generated by the evacuation.

4. The die casting machine of claim 1, wherein:

the first and second ejecting pins are configured to project into a runner in the cavity, the release agent feed path opens into the cavity side at the first opening of the first ejecting pin, and the lubricant feed path opens into the sleeve side at the second opening of the second ejecting pin.

5. A die casting machine, comprising:

a pair of dies forming a cavity;

a sleeve having two split parts that are connected to the dies, the sleeve configured to communicate with the cavity formed between the pair of dies and to accommodate feeding of molten metal;

a plunger that fits into the sleeve and injects the molten metal fed to the sleeve toward the cavity;

an electromagnetic pump configured to feed the molten metal inside the sleeve through a melt feed pipe connected to one of the split parts of the sleeve;

an evacuating mechanism configured to evacuate and reduce the pressure inside the cavity when the dies are clamped;

a movable pin having a release agent feeding mechanism configured to feed a powder release agent into the cavity, the powder release agent designed to facilitate release of a casting from the die during evacuation by the evacuating mechanism; and a lubricant feeding mechanism configured to inject a powder lubricant toward an inner circumference of the sleeve, the powder lubricant designed to reduce friction between the inner circumference of the sleeve and the plunger after the evacuation by the evacuating mechanism; and a gas evacuating mechanism configured to evacuate gas within the cavity and the sleeve to the outside when pressure inside a closed space formed by inner surfaces of the cavity and the sleeve and a liquid surface of the molten metal inside the melt feed pipe rises above ambient pressure.

6. The die casting machine of claim 5, wherein the gas evacuating mechanism has a check valve provided between a chill-vent provided between the dies and outside of the dies.

7. The die casting machine of claim 6, wherein the gas evacuating mechanism comprises a check valve provided in an evacuation path connecting between the evacuating mechanism and the cavity and the outside of the dies.

* * * * *